US010514640B2

(12) United States Patent
Sudo

(10) Patent No.: US 10,514,640 B2
(45) Date of Patent: Dec. 24, 2019

(54) IMAGE FORMING METHOD AND IMAGE FORMING APPARATUS

(71) Applicant: Konica Minolta, Inc., Tokyo (JP)

(72) Inventor: Susumu Sudo, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/381,589

(22) Filed: Apr. 11, 2019

(65) Prior Publication Data

US 2019/0346794 A1 Nov. 14, 2019

(30) Foreign Application Priority Data

May 9, 2018 (JP) ..... 2018-090676

(51) Int. Cl.
*G03G 15/20* (2006.01)

(52) U.S. Cl.
CPC ..... *G03G 15/206* (2013.01)

(58) Field of Classification Search
CPC ..... G03G 15/206
See application file for complete search history.

(56) References Cited

U.S. PATENT DOCUMENTS

2002/0106573 A1* 8/2002 Hamano ..... G03G 9/08755 430/111.4
2003/0054280 A1* 3/2003 Ishihara ..... G03G 9/0821 399/330
2005/0002704 A1* 1/2005 Nakamura ..... G03G 15/2064 399/341
2005/0100808 A1* 5/2005 Hashimoto ..... G03G 9/0806 430/108.8
2015/0104215 A1* 4/2015 Tatsuura ..... G03G 15/10 399/237
2018/0224764 A1* 8/2018 Nishitera ..... G03G 9/0821

FOREIGN PATENT DOCUMENTS

JP 2005-173259 A 6/2005
JP 2010-211080 A 9/2010

* cited by examiner

*Primary Examiner* — Susan S Lee
(74) *Attorney, Agent, or Firm* — Lucas & Mercanti, LLP

(57) ABSTRACT

An image forming method includes developing an electrostatic latent image formed on a photoreceptor with a toner, transferring a formed toner image onto a recording material, and fixing the toner image on a surface of the recording material, in which a storage elastic modulus of the toner is $2.0\times10^6$ Pa or more at 70° C. and $4.0\times10^4$ Pa or less at 90° C., and in the fixing, a fixing belt having an elastic layer which contains a material having a storage elastic modulus of $1.0\times10^6$ Pa or more and $2.5\times10^6$ Pa or less at 200° C. is used.

9 Claims, 5 Drawing Sheets

IMAGE FORMING METHOD AND IMAGE FORMING APPARATUS

CROSS-REFERENCE TO RELATED APPLICATION

The entire disclosure of Japanese Patent Application No. 2018-90676, filed on May 9, 2018, is incorporated herein by reference in its entirety.

BACKGROUND

1. Technological Field

The present invention relates to an image forming method and an image forming apparatus used in the method.

2. Description of the Related Arts

Conventionally, in an image forming method using an electro-photographic image forming apparatus including a copying machine, a laser beam printer, and the like, a fixing section (referred to as a fixing device) which brings a heated fixing belt into contact with a transfer material carrying an unfixed toner image to fix a toner image on the transfer material has been adopted. As the fixing section in such an image forming apparatus, a fixing section including an endless fixing belt, a fixing roller and a heating roller which pivotally support the fixing belt, and a pressure roller which is pressed against the fixing roller with a predetermined pressure with the fixing belt interposed therebetween, and a local heating unit which heats the heating roller has been known.

With the diversification of printing technology, there are also various demands for an image formed by an image forming method using an electro-photographic image forming apparatus. One of various demands is gloss of an image, and in order to form an image having various glosses, it has been necessary to properly use plural types of image forming apparatuses so far. To solve such a problem, by devising a mechanical structure or arrangement of the existing fixing section as described above, a technology of enabling even an image forming method using one image forming apparatus to form an image with high gloss and an image with low gloss according to a user's request has been known. For example, there has been proposed that two fixing devices (fixing sections) are mounted in which a first fixing device includes a sheet discharge switching section switching a conveying direction of recording sheet to which a toner image is fixed and a second fixing device to which the recording sheet is conveyed can re-heat, cool, solidify, and then peel off the toner image (Japanese Patent Application Laid-Open No. 2005-173259) in the case of outputting the image with high gloss. In addition, there has been proposed that a plurality of pressure rollers each configured to be able to be switched and move to positions where nip portions are formed are mounted (Japanese Patent Application Laid-Open No. 2010-211080).

SUMMARY

However, as described in Japanese Patent Application Laid-Open No. 2005-173259 and Japanese Patent Application Laid-Open No. 2010-211080, in one image forming apparatus and an image forming method using the same, in order to form an image with low gloss and an image with high gloss, it is necessary to mechanically perform switching of high gloss and low gloss by using an image forming apparatus having two fixing devices (fixing sections), using an apparatus having a plurality of movable (switchable) fixing pressure rollers, or the like. Therefore, there is a problem that the image forming apparatus is increased in size, cost, and the like.

An object of the present invention is to provide an image forming method capable of stably forming an image with high gloss and an image with low gloss only by changing a fixing temperature, and a fixing section and an image forming apparatus used in the image forming method.

The inventors of the present invention conducted intensive studies. As a result, it was found that the above problem can be solved by the following image forming method, and the present invention has been completed.

In order to realize at least one of the above objects, an image forming method which reflects one aspect of the present invention includes developing an electrostatic latent image formed on a photoreceptor with a toner, transferring a formed toner image onto a recording material, and fixing the toner image on a surface of the recording material.

A storage elastic modulus of the toner is $2.0\times10^6$ Pa or more at 70° C. and $4.0\times10^4$ Pa or less at 90° C., and in the fixing, a fixing belt having an elastic layer which contains a material having a storage elastic modulus of $1.0\times10^6$ Pa or more and $2.5\times10^6$ Pa or less at 200° C. is used.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
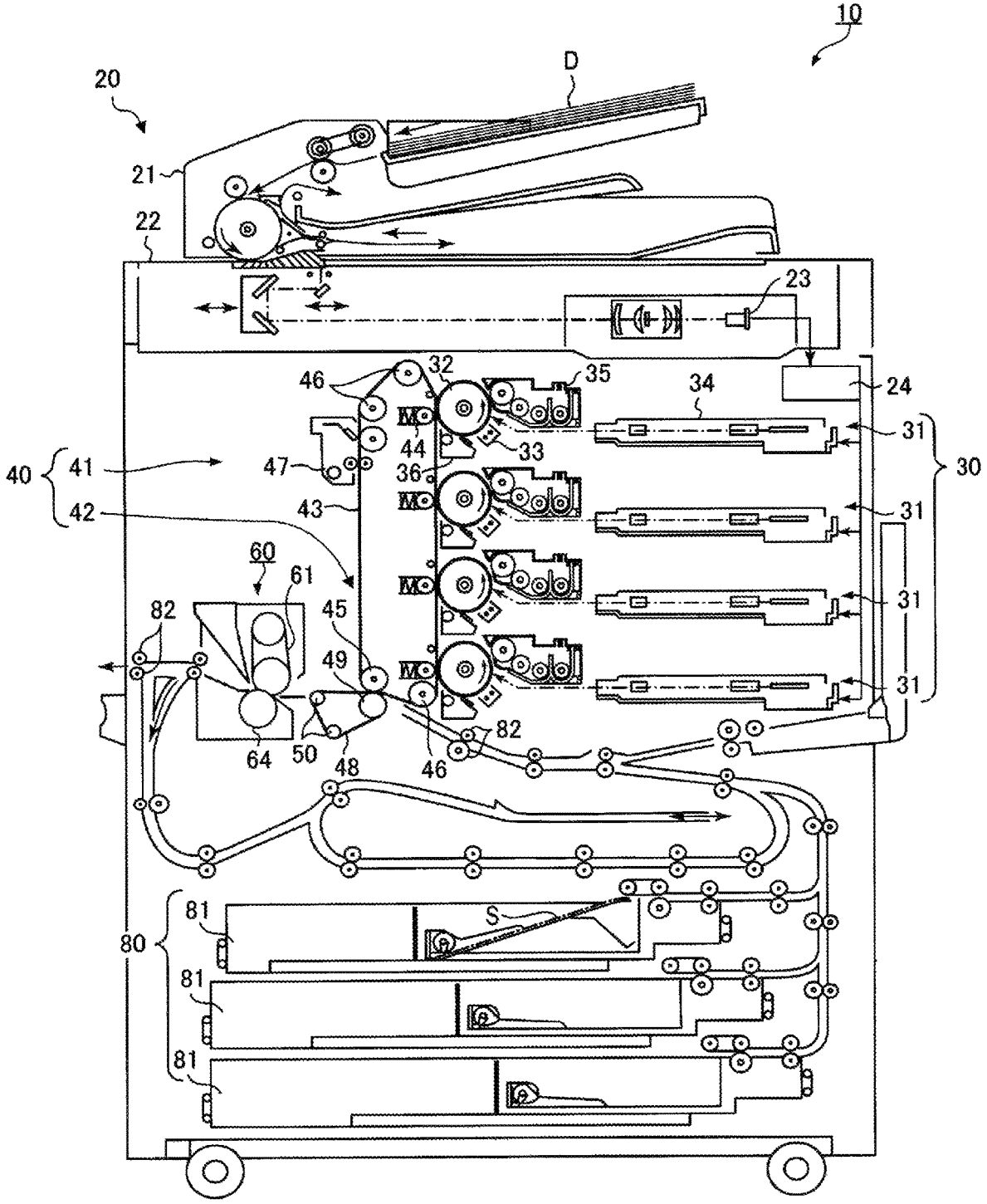
FIG. 1 is a schematic cross-sectional view showing a configuration of an image forming apparatus used in an image forming method according to an embodiment of the present invention, in which reference numeral 10 denotes an image forming apparatus, reference numeral 20 denotes an image reading section, reference numeral 21 denotes a sheet feeding device, reference numeral 22 denotes a scanner, reference numeral 23 denotes a CCD sensor, reference numeral 24 denotes an image processing section, reference numeral 30 denotes an image forming section, reference numeral 31 denotes an image forming unit, reference numeral 32 denotes a photoreceptor drum, reference numeral 33 denotes a charging device, reference numeral 34 denotes an exposure device, reference numeral 35 denotes a developing section, reference numeral 36 denotes a cleaning device, reference numeral 40 denotes an intermediate transfer section, reference numeral 41 denotes a primary transfer unit, reference numeral 42 denotes a secondary transfer unit, reference numeral 43 denotes an intermediate transfer belt, reference numeral 44 denotes a primary transfer roller, reference numeral 45 denotes a backup roller, reference numeral 46 denotes a first support roller, reference numeral 47 denotes a cleaning device, reference numeral 48 denotes a secondary transfer belt, reference numeral 49 denotes a secondary transfer roller, reference numeral 50 denotes a second support roller, reference numeral 60 denotes a fixing section, reference numeral 61 denotes a fixing belt, reference numeral 64 denotes a second pressure roller, reference numeral 80 denotes a recording material conveying section, reference numeral 81 denotes a sheet feeding tray unit, reference numeral 82 denotes a resist roller pair, reference numeral D denotes a document, and reference numeral S denotes a recording material.

Hereinafter, one or more embodiments of the present invention will be described with reference to the drawings. However, the scope of the invention is not limited to the disclosed embodiments. In the description of the drawings, the same elements are denoted by the same reference numerals, and redundant description is omitted. In addition, in some cases, dimensional ratios in the drawings are exaggerated and different from actual ratios for convenience of the description.

In the present specification, unless otherwise specified, measurement of operation, physical properties and the like is carried out under the conditions of room temperature (20° C. or higher and 25° C. or lower)/relative humidity (RH) of 40% RH or more and 50% RH or less.

An image forming method according to an embodiment of the present invention includes developing an electrostatic latent image formed on a photoreceptor with a toner, transferring a formed toner image onto a recording material, and fixing the toner image on a surface of the recording material, in which a storage elastic modulus of the toner is $2.0\times10^6$ Pa or more at 70° C. and $4.0\times10^4$ Pa or less at 90° C., and in the fixing, a fixing belt having an elastic layer which contains a material having a storage elastic modulus of $1.0\times10^6$ Pa or more and $2.5\times10^6$ Pa or less at 200° C. is used.

An image forming apparatus according to an embodiment of the present invention includes a toner and a fixing belt used in the image forming method of the above embodiment. More specifically, the image forming apparatus includes a developing section which accommodates the toner and develops an electrostatic latent image formed on a photoreceptor with the toner, a transfer section which transfers the formed toner image onto a recording material, and a fixing section which passes the recording material having the toner image formed on a surface thereof through a fixing nip and fixes the toner image on the surface of the recording material using the fixing belt. The fixing section includes an endless fixing belt, a heating roller which has a heating device for heating the fixing belt from an inside thereof, two or more rollers which pivotally support the fixing belt, and a pressure roller which is disposed so as to be relatively biased with respect to one of the rollers via the fixing belt, in which a roller diameter of a roller biased to the pressure roller among the two or more rollers is in the range of 45 mm or more.

In the image forming method and the image forming apparatus according to the present embodiment having the above-described configuration, it is possible to effectively express the effect of the above-described invention. More specifically, by combining a toner having a storage elastic modulus in a predetermined range at 70° C. and 90° C. with the fixing belt having the elastic layer which contains a material having a storage elastic modulus in a predetermined range at 200° C., it is possible to stably obtain an image with low gloss and an image with high gloss only by changing a fixing temperature. By doing so, it is possible to freely form an image with high gloss and an image with low gloss according to the user's request. In addition, it is possible to reduce the size and cost of the image forming apparatus. Hereinafter, the image forming method and the image forming apparatus according to the embodiment of the present invention will be described.

(Image Forming Method and Image Forming Apparatus)

Figure 2:
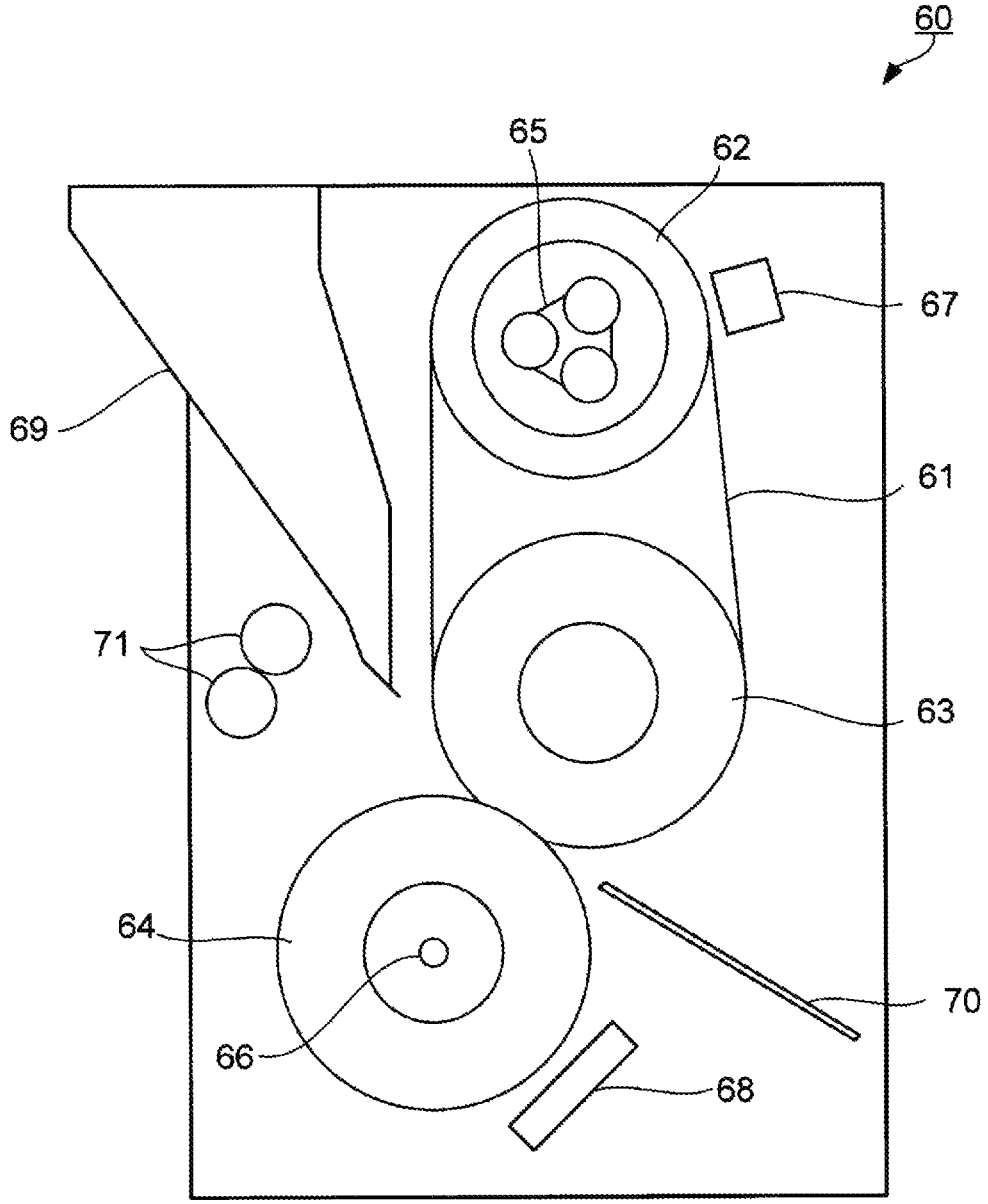
FIG. 2 is a schematic cross-sectional view showing a configuration of a fixing section used in the image forming method according to the embodiment of the present invention, in which reference numeral 60 denotes a fixing section, reference numeral 61 denotes a fixing belt, reference numeral 62 denotes a heating roller, reference numeral 63 denotes a first pressure roller, reference numeral 64 denotes a second pressure roller, reference numeral 65 denotes a heater, reference numeral 66 denotes a heater, reference numeral 67 denotes a first temperature sensor, reference numeral 68 denotes a second temperature sensor, reference numeral 69 denotes an airflow separation device, reference numeral 70 denotes a guide plate, and reference numeral 71 denotes a guide roller.

FIG. 1 is a cross-sectional view showing a configuration of an image forming apparatus 10 used in an image forming method according to an embodiment of the present invention. FIG. 2 is a schematic cross-sectional view showing a configuration of a fixing section 60. As shown in FIG. 1, the image forming apparatus 10 includes an image reading section 20, an image forming section 30, an intermediate transfer section 40, a fixing section 60, and a recording material conveying section 80.

The image reading section 20 reads an image from a document D and obtains image data for forming an electrostatic latent image. The image reading section 20 includes a sheet feeding device 21, a scanner 22, a CCD sensor 23, and an image processing section 24.

The image forming section 30 includes, for example, four image forming units 31 corresponding to respective colors of yellow, magenta, cyan, and black. The image forming unit 31 includes a photoreceptor drum 32, a charging device 33, an exposure device 34, a developing section 35, and a cleaning device 36.

The photoreceptor drum 32 is, for example, a negatively chargeable organic photoreceptor having photoconductivity. The charging device 33 charges the photoreceptor drum 32. The charging device 33 is, for example, a corona charger. The charging device 33 may be a contact charging device which brings contact charging members, such as a charging roller, a charging brush, and a charging blade, into contact with the photoreceptor drum 32 to perform charging. The exposure device 34 irradiates light to the charged photoreceptor drum 32 to form an electrostatic latent image. The exposure device 34 is, for example, a semiconductor laser. The developing section 35 supplies a toner to the photoreceptor drum 32 on which the electrostatic latent image is formed, and forms a toner image corresponding to the electrostatic latent image. The developing section 35 is, for example, a known developing section (developing device) in an electro-photographic image forming apparatus. The cleaning device 36 removes residual toner on the photoreceptor drum 32. Here, the "toner image" refers to a state in which the toner is agglomerated in an image form.

The toner is not particularly limited as long as it satisfies the requirement that the storage elastic modulus is $2.0\times10^6$ Pa or more at 70° C. and $4.0\times10^4$ Pa or less at 90° C., and can be appropriately selected and used from among the known toners. The toner may form a one-component developer or a two-component developer. The one-component developer is composed of toner particles. In addition, the two-component developer is composed of toner particles and carrier particles. The toner particles are composed of toner base particles and external additives such as silica attached to the surface thereof. The toner base particles are composed of, for example, a binder resin, a colorant, and a wax. The specific configuration or the like of the toner will be described later.

The intermediate transfer section 40 includes a primary transfer unit 41 and a secondary transfer unit 42. The primary transfer unit 41 includes an intermediate transfer belt 43, a primary transfer roller 44, a backup roller 45, a plurality of first support rollers 46, and a cleaning device 47. The intermediate transfer belt 43 is an endless belt.

The intermediate transfer belt 43 is stretched by the backup roller 45 and the first support roller 46. The intermediate transfer belt 43 runs at a constant speed in one direction on an endless track by rotationally driving at least one roller of the backup roller 45 and the first support roller 46.

The secondary transfer unit 42 includes a secondary transfer belt 48, a secondary transfer roller 49, and a plurality of second support rollers 50. The secondary transfer belt 48 is an endless belt. The secondary transfer belt 48 is stretched by the secondary transfer roller 49 and the second support roller 50.

As shown in FIG. 2, the fixing section 60 includes an endless fixing belt 61, a heating roller 62 which has a heating device (heater) 65 for heating the fixing belt 61 from the inside, two rollers 62 and 63 which pivotally support the fixing belt 61, and a pressure roller 64 which is disposed so as to be relatively biased with respect to one (the roller 63) of the two rollers via the fixing belt 61. Among the rollers, the diameter of the roller 63 biased to the pressure roller 64 is preferably 45 mm or more, and more preferably 60 mm or more. If the diameter of the roller is within the above range, it is possible to not only achieve the effect of the invention effectively, to but also form an image at a higher speed and save energy more effectively. The upper limit of the diameter of the roller can be appropriately determined depending on, for example, the allowable size of the fixing device, but is, for example, 90 mm or less.

In the fixing belt 61, a base layer 61*a*, an elastic layer 61*b*, and a surface layer (release layer) 61*c* are laminated in this order (see FIG. 3). The fixing belt 61 is pivotally supported by the heating roller 62 and the first pressure roller 63 in a state in which the base layer 61*a* is an inner side and the surface layer (release layer) 61*c* is an outer side. The tension of the fixing belt 61 is, for example, 43 N. In other words, the fixing belt is pivotally supported by the two rollers 62 and 63 so as to have the tension of 43 N. That is, in the present invention, the tension of the fixing belt pivotally supported by the two or more rollers is preferably 46 N or less, and more preferably 43 N or less. The lower limit of the tension of the fixing belt can be appropriately determined depending on, for example, the minimum fixing power or the gloss allowed by the fixing device, but is, for example, 30 N or more. If the tension of the fixing belt is within the above range, it is possible to not only achieve the effect of the invention effectively, to but also form an image at a higher speed and save energy more effectively. The tension can be adjusted, for example, by an elastic force (biasing force) of an elastic member such as a spring which biases the roller in a direction in which an inter-shaft distance of the rollers is expanded, an inter-shaft distance of the roller that pivotally supports the fixing belt or the like. Since one of the features of this embodiment is the fixing belt 61, a detailed description of the fixing belt 61 will be described later.

The heating roller 62 has a rotatable aluminum sleeve and a heater 65 disposed therein. The first pressure roller 63 has, for example, a rotatable core metal and an elastic layer disposed on an outer peripheral surface thereof.

The second pressure roller 64 is disposed to face the first pressure roller 63 via the fixing belt 61. The second pressure roller 64 has, for example, a rotatable aluminum sleeve and a heater 66 disposed in the sleeve. The second pressure roller 64 is disposed so as to freely move toward and away from the first pressure roller 63, and when approaching the first pressure roller 63, the second pressure roller 64 presses the elastic layer of the first pressure roller 63 via the fixing belt 61 to form a fixing nip portion which is a contact portion with the fixing belt 61.

A first temperature sensor 67 is a device for detecting a temperature of the fixing belt 61 heated by the heating roller 62. In addition, a second temperature sensor 68 is a device for detecting a temperature of an outer peripheral surface of the second pressure roller 64.

An airflow separation device 69 is an apparatus for generating airflow from a downstream side in the moving direction of the fixing belt 61 toward the fixing nip portion to promote a separation of a recording material S from the fixing belt 61.

A guide plate 70 is a member for guiding the recording material S having an unfixed toner image to the fixing nip portion. A guide roller 71 is a member for guiding the recording material having the toner image fixed thereon from the fixing nip portion to the outside of the image forming apparatus 10.

Return to a description with reference to FIG. 1. The recording material conveying section 80 has three sheet feeding tray units 81 and a plurality of resist roller pairs 82. The recording material (standard sheet, special sheet, and the like in the present embodiment) S identified based on a basis weight, a size, and the like is accommodated in the sheet feeding tray unit 81 for each preset type. The resist roller pair 82 is disposed so as to form a desired conveying path.

In such an image forming apparatus 10, based on the image data acquired by the image reading section 20, the intermediate transfer section 40 forms the toner image on the recording material S conveyed by the recording material conveying section 80. The recording material S on which the toner image is formed by the intermediate transfer section 40 is conveyed to the fixing section 60.

The fixing belt 61 in the fixing section 60 rotates at a predetermined speed, and is heated to a desired temperature (for example, 190° C.) by the heater 65 based on a feedback control of the first temperature sensor 67, for example. The second pressure roller 64 is heated to a desired temperature (for example, 180° C.) by the heater 66 based on a feedback control of the second temperature sensor 68, for example. Then, in accordance with the arrival of the recording material S, the second pressure roller 64 biases the outer peripheral surface of the first pressure roller 63 via the fixing belt 61 to form the fixing nip portion.

On the other hand, the recording material S carrying the unfixed toner image is guided to the nip portion while being guided to the guide plate 70. The fixing belt 61 closely contacts the recording material S, so the unfixed toner image is quickly fixed to the recording material S. In addition, the recording material S receives the airflow from the airflow separation device 69 at a downstream end of the fixing nip portion. Therefore, the separation of the recording material S from the fixing belt 61 is promoted. The recording material separated from the fixing belt 61 is guided toward the outside of the image forming apparatus 10 by the guide roller 71.

That is, the image forming apparatus according to the embodiment of the present invention is an image forming apparatus including a fixing section which fixes an unfixed toner image, which is formed on a recording material by an electro-photographic scheme, to the recording material by heating and pressurization, in which the fixing section is preferably the above-described fixing section 60. Here, the above-described fixing section 60 is a fixing section which includes a fixing belt having an elastic layer using an elastic layer material having a specific storage elastic modulus according to the embodiment of the present invention, and as the fixing section, has the configuration and arrangement of the fixing belt 61 to the pressure roller 64. By having such a configuration, the effect of the above-described invention can be effectively expressed.

Although the image forming method has been described using the above-described configuration of the fixing section 60 and the image forming apparatus 10, each step of the image forming method other than the fixing step will be described in detail below.

By the start of the image recording, a photoreceptor driving motor (not shown) starts, a Y photoreceptor drum 32 (the uppermost photoreceptor drum in FIG. 1) rotates in a direction indicated by the arrow in FIG. 1, and a potential is applied to the Y photoreceptor drum 32 by a Y charging device 33. Thereafter, exposure (image writing) by an electric signal corresponding to a first color signal, that is, a Y image data is performed by a Y exposure device 34, and an electrostatic latent image corresponding to a Y image is formed on the Y photoreceptor drum 32. The electrostatic latent image is reversely developed by the Y developing section 35, and a toner image composed of a yellow (Y) toner is formed on the Y photoreceptor drum 32 (developing step). The formed yellow (Y) toner image is transferred onto the intermediate transfer belt 43, which is an intermediate transfer member, by a primary transfer roller 44 as a primary transfer unit.

Next, a potential is applied to a magenta (M) photoreceptor drum 32 (a second photoreceptor drum from the top in FIG. 1) by an M charger 33. Thereafter, exposure (image writing) by an electric signal corresponding to a first color signal, that is, an M image data is performed by an M exposure device 34, and an electrostatic latent image corresponding to an M image is formed on the M photoreceptor drum 32. The electrostatic latent image is reversely developed by the M developing section 35, and a toner image composed of a magenta (M) toner is formed on the M photoreceptor drum 32. The formed magenta (M) toner image is superimposed on the Y toner image and transferred onto the intermediate transfer belt 43, which is the intermediate transfer member, by the primary transfer roller 44 as the primary transfer unit.

By a similar process, a toner image formed of cyan (C) toner formed on a C photoreceptor drum 322 (a third photoreceptor drum from the top in FIG. 1) and a toner image composed of a black (K) toner formed on a K photoreceptor drum 322 (a lowermost photoreceptor drum in FIG. 1) are superimposed on the intermediate transfer belt 43 in this order. As a result, the superimposed color toner images composed of Y, M, C, and K toners are formed on a circumferential surface of the intermediate transfer belt 43. The toner remaining on the circumferential surface of each photoreceptor drum 32 after the transfer is cleaned by the photoreceptor cleaning device 36.

On the other hand, the recording material S accommodated in three sheet feeding tray units 81 of the recording material conveying section 80 is fed by feed rollers and sheet feeding rollers which are provided in the three sheet feeding tray units 81, respectively, and is conveyed on a conveyance route by a conveying roller. Thereafter, the recording material S is conveyed to a secondary transfer belt 48 as a secondary transfer unit to which a voltage having opposite polarity (positive polarity in this embodiment) to the toner is applied through the resist roller pair 82, and the superimposed color toner images formed on the intermediate transfer belt 43 are collectively transferred onto the recording material S in a transfer area of the secondary transfer belt 48 (transferring step).

After the toner image is transferred onto the recording material S by the secondary transfer belt 48 as the secondary transfer unit, the residual toner on the intermediate transfer belt 43, from which the recording material S has undergone curvature separation, is removed by the intermediate transfer belt cleaning device 47. In addition, a patch image toner on the secondary transfer belt 48 is cleaned by a cleaning blade (not shown) of the secondary transfer unit 42.

On the other hand, the recording material S to which the toner image is transferred is heated and pressed and fixed at the nip portion of the fixing section 60 (fixing step), nipped by the guide roller 71, and placed on the discharge tray outside the image forming apparatus 10. In the present invention, by combining a toner having a specific storage elastic modulus with a fixing belt having an elastic layer using an elastic layer material having the specific storage elastic modulus, the fixing temperature (=the surface temperature of the fixing belt) at the nip portion is only changed, for example, from 10° C. to 15° C., so it is possible to stably obtain an image with low gloss and an image with high gloss.

(Structure of Fixing Belt)

Figure 4:
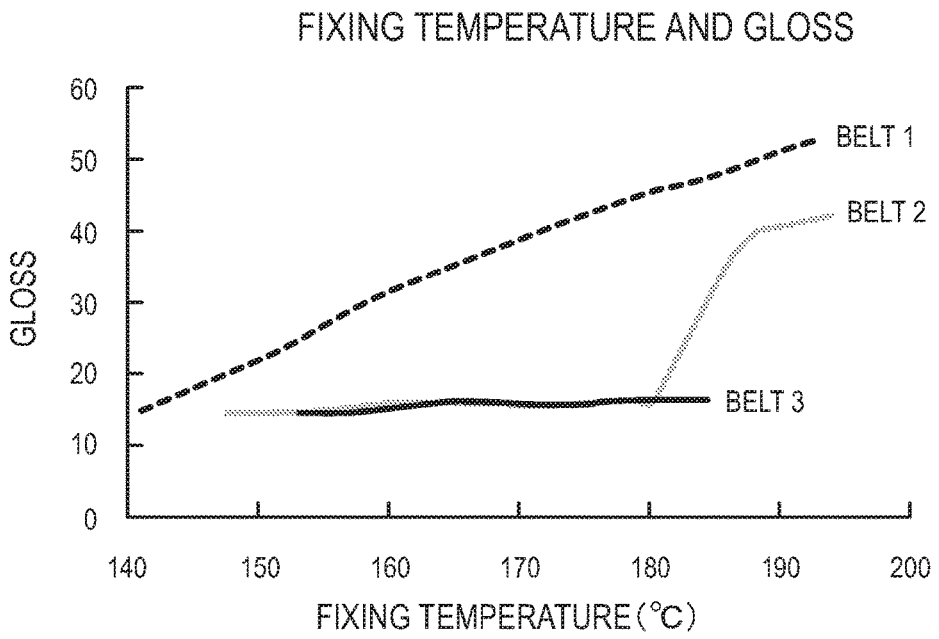
FIG. 4 is a graph showing the relationship between a fixing temperature and gloss.

The fixing belt according to the embodiment of the present invention has an elastic layer using an elastic layer material having a storage elastic modulus in the range of $1.0\times10^6$ Pa or more and $2.5\times10^6$ Pa or less at 200° C. By using the fixing belt having the elastic layer, by combining with a toner having a specific storage elastic modulus which will be described later, it is possible to stably obtain the image with low gloss and the image with high gloss only by changing the fixing temperature, for example, from 10° C. to 15° C. In this way, it is possible to simply form the image with low gloss and the image with high gloss only by the small change in the fixing temperature (for example, about 10° C. to 15° C.). Therefore, it is possible to avoid increasing the size and cost of the image forming apparatus, and it is possible to form an image having various glosses according to the user's request only by changing the fixing temperature in multiple stages. When the storage elastic modulus of the elastic layer material at 200° C. is less than $1.0\times10^6$ Pa, there is no inflection point as shown in FIG. 4 is even when combined with a toner having a storage elastic modulus in a specific range. Therefore, only the change of the fixing temperature, for example, from 10° C. to 15° C. is not preferable because only image with high gloss cannot be obtained and only the image with low gloss cannot be formed even in the fixing temperature range (see a graph of the belt 3 in Comparative Example 2 and FIG. 4). On the other hand, when the storage elastic modulus of the elastic layer material at 200° C. exceeds $2.5\times10^6$ Pa, there is no inflection point as shown in FIG. 4 is even when combined with a toner having a storage elastic modulus in a specific range. Therefore, only the change of the fixing temperature, for example, from 10° C. to 15° C. is not preferable because only image with low gloss cannot be obtained and only the image with high gloss cannot be formed even in the fixing temperature range (see a graph of the belt 1 in Comparative Example 1 and FIG. 4). From such a viewpoint, the fixing belt preferably has an elastic layer containing a material having a storage elastic modulus in the range of $1.2\times10^6$ Pa or more and $2.4\times10^6$ Pa or less at 200° C., and more preferably has an elastic layer containing a material in the range of $1.5\times10^6$ Pa or more and $2.4\times10^6$ Pa or less. The storage elastic modulus of the elastic layer material is a value obtained by the measuring method to be described in Examples below.

Figure 3A:
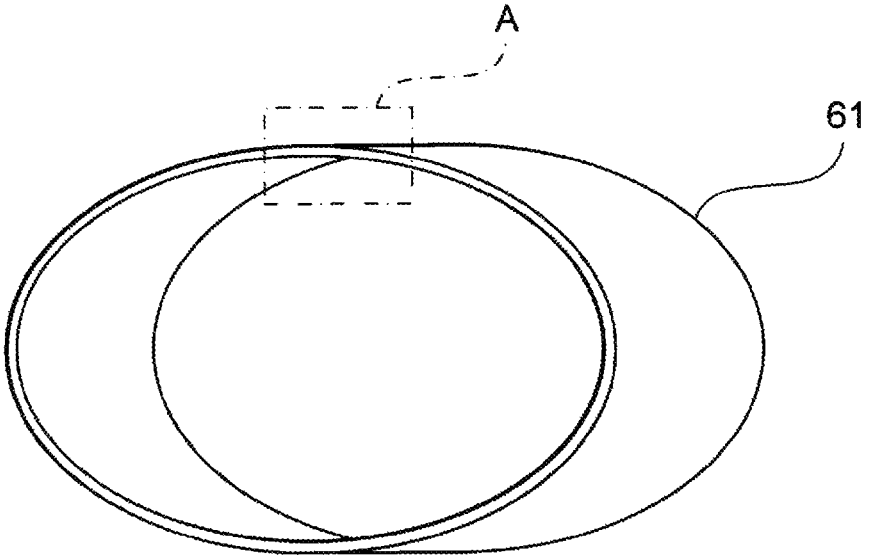
FIG. 3A is a diagram schematically showing an example of a fixing belt which is a constituent member of the fixing section used in the image forming method according to the embodiment of the present invention, in which reference numeral 61 denotes a fixing belt, and reference numeral A denotes a region.

The configuration of the fixing belt other than the requirement of the storage elastic modulus is not particularly limited, and the conventionally known configuration of the fixing belt can be appropriately selected and used. Hereinafter, a representative configuration of the fixing belt will be described with reference to the drawings, but the present invention is not limited thereto. FIG. 3A is a perspective view of the fixing belt 61, and FIG. 3B is an enlarged view of region A shown in FIG. 3A.

Figure 3B:
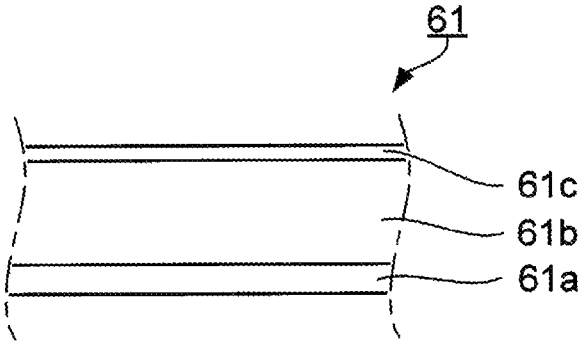
FIG. 3B is an enlarged view of region A shown in FIG. 3A, in which reference numeral 61 denotes a fixing belt, reference numeral 61*a* denotes a base layer, reference numeral 61*b* denotes an elastic layer, and reference numeral 61*c* denotes a surface layer.

As shown in FIGS. 3A and 3B, the fixing belt 61 has a base layer 61*a*, an elastic layer 61*b*, and a surface layer (also referred to as a release layer) 61*c* in this order. In addition, the base layer 61*a* is positioned on the inner side of the fixing belt 61 and the surface layer (release layer) 61*c* is positioned on the outer side of the fixing belt 61.

The base layer 61*a* is obtained using a heat-resistant resin. The heat-resistant resin is appropriately selected from resins which do not cause denaturation and deformation within the range of the use temperature of the fixing belt 61, and may be one type or more. Examples of the heat-resistant resin include polyphenylene sulfide, polyarylate, polysulfone, polyether sulfone, polyether imide, polyimide, polyamide imide, and polyether ether ketone. The heat-resistant resin is preferably polyimide from the viewpoint of heat resistance.

Polyimide can be obtained by heating a polyamic acid, which is a precursor thereof, at a temperature of 200° C. or higher or by progressing a dehydration/cyclization (imidization) reaction of a polyamic acid using a catalyst. The polyamic acid may be produced by dissolving a tetracarboxylic acid dianhydride and a diamine compound in a solvent, and performing a polycondensation reaction by mixing and heating, or a commercially available product may be used. Examples of the diamine compound and the tetracarboxylic acid dianhydride include the compounds described in paragraphs 0123 to 0130 of Japanese Patent Application Laid-Open No. 2013-25120.

The base layer 61*a* may further contain components other than the heat-resistant resin within a range in which properties such as heat resistance required for the base layer are not impaired. For example, the material of the base layer 61*a* may further contain other resin components. The content of the heat-resistant resin in the material of the base layer 61*a* is preferably from 40 vol % or more and 100 vol % or less from the viewpoint of moldability and the like.

A thickness of the base layer 61*a* is preferably 40 μm or more and 110 μm or less, more preferably 50 μm or more and 100 μm or less, and still more preferably 60 μm or more and 90 μm or less, from the viewpoint of imparting durability to the belt and sufficiently express good image quality.

The elastic layer 61*b* is obtained using an elastic layer material. Examples of the elastic layer material include elastic resin materials such as silicone rubber, thermoplastic elastomer, and a rubber material. Among those, the elastic resin material is preferably silicone rubber.

The silicone rubber may be one type or more. Examples of the silicone rubber include polyorganosiloxane or a heat-cured product thereof, and addition reaction type silicone rubber described in Japanese Patent Application Laid-Open No. 2009-122317, and the like. Examples of the polyorganosiloxane include dimethylpolysiloxane, whose both ends are capped with a trimethylsiloxane group and side chain has a vinyl group, described in paragraph 0029 of Japanese Patent Application Laid-Open No. 2008-255283, and the like.

The elastic layer material may further contain components other than the elastic resin material in the range in which the properties (storage elastic modulus, heat conductivity, elasticity, or the like of the elastic layer material) required for the elastic layer are not damaged. For example, the elastic layer material may further include a heat conductive filler as components other than the elastic resin material for further enhancing the heat conductivity of the elastic layer. Examples of the filler material include silica, metallic silica, alumina, zinc, aluminum nitride, boron nitride, silicon nitride, silicon carbide, carbon, and graphite. The shape of the filler has, for example, a spherical powder, an amorphous powder, a flat powder, or a fibrous form without being limited. As the component other than the elastic resin material, a crosslinking agent may be further included for crosslinking the elastic resin material. Examples of the crosslinking agent include a hydroxyl group-containing siloxane-based crosslinking agent (for example, hydroxyl group-containing dimethylpolysiloxane, and the like), a sulfur crosslinking agent, a peroxide crosslinking agent, and the like.

The content of the elastic resin material in the elastic layer (elastic layer material) is preferably 60 vol % or more and 100 vol % or less, more preferably 75 vol % or more and 100 vol % or less, and still more preferably 80 vol % or more and 100 vol % or less.

The elastic layer 61*b* is formed by appropriately selecting, from the elastic layer materials, a material in the range in which the storage elastic modulus at 200° C. (hereinafter, also simply referred to as storage elastic modulus) is $1.0\times10^6$ Pa or more and $2.5\times10^6$ Pa or less. The storage elastic modulus of the elastic layer material is a value obtained by the measuring method described in Examples below. The storage elastic modulus of the elastic layer material can be adjusted by the method described in Examples, taking the silicone rubber suitable as a material as an example. For example, in a composition in which a polyorganosiloxane as the elastic resin material, a hydroxyl group-containing dimethylpolysiloxane as the crosslinking agent, and silica as the heat conductive filler material are mixed, it is possible to freely adjust the storage elastic modulus of the elastic layer material by adjusting a mixing ratio in the case of using a type of polyorganosiloxane or a plural types of polyorganosiloxane, an added amount or a type of heat conductive filler material, an added amount or a type of crosslinking agent, and the like. Silicone rubber materials C and D in Table 4 are examples of preparing silicone rubber material having the storage elastic modulus of the elastic layer material which is out of the range of the present invention by the same adjustment method.

A thickness of the elastic layer 61*b* is preferably 30 μm or more and 600 μm or less, more preferably 100 μm or more and 550 μm or less, and still more preferably 150 μm or more and 500 μm or less, from the viewpoint of sufficiently expressing the heat conductivity and the elasticity. If the thickness of the elastic layer 61*b* is in the above range, it is possible to stably obtain the image with low gloss and the image with high gloss, and furthermore, sufficiently secure the heat conductivity and the elasticity required for the elastic layer 61*b*, only by changing the fixing temperature. However, the thickness of the elastic layer 61*b* is not limited to the above range as long as it does not impair the effects of the present embodiment and the properties such as the heat conductivity and the elasticity required for the elastic layer.

The surface layer (release layer) 61*c* has appropriate releasability for the toner. The surface layer 61*c* is positioned on the outer surface of the fixing belt 61 which comes into contact with the recording material S at the time of the fixing. Examples of the material of the surface layer 61*c* include a resin matrix material. Examples of the resin matrix material include polyethylene, polypropylene, polystyrene, polyisobutylene, polyester, polyurethane, polyamide, polyimide, polyamideimide, alcohol-soluble nylon, polycarbonate, polyarylate, phenol, polyoxymethylene, polyetheretherketone, polyphosphazene, polysulfone, polyethersulfide, polyphenylene oxide, polyphenylene ether, polyparabanic acid, polyallylphenol, fluororesin, polyurea, ionomer, silicone, and mixtures thereof or copolymers thereof. From the viewpoint of the releasability and the heat resistance, the material of the surface layer 61*c* is preferably a fluororesin, and more preferably a perfluoroalkoxy fluororesin (PFA).

The thickness of the surface layer 61*c* is preferably 3 μm or more and 60 μm or less, more preferably 5 μm or more and 50 μm or less, still more preferably 10 μm or more and 45 μm or less, and particularly preferably 15 μm or more and 40 μm or less, from the viewpoint of, for example, the heat conductivity, the flexibility following up the deformation of the elastic layer, and the releasability. However, the thickness of the surface layer 61*c* is not limited to the above range as long as it does not impair the effects of the present embodiment and the properties such as the heat conductivity, the flexibility following up the deformation of the elastic layer, the releasability, and the heat resistance.

The surface layer 61*c* may further contain components other than the resin matrix material within the range in which the properties such as the heat resistance required for the surface layer are not impaired. For example, the surface layer 61*c* may further contain lubricant particles. Examples of the lubricant particles include fluororesin particles, silicone resin particles, and silica particles.

The content of the resin matrix material in the material of the surface layer 61*c* is preferably 70 vol % or more and 100 vol % or less from the viewpoint of the heat conductivity, the flexibility capable of sufficiently following up the deformation of the elastic layer, and the like.

The fixing belt 61 may further include other layers other than the base layer 61*a*, the elastic layer 61*b*, and the surface layer (release layer) 61*c* described above within the range where the effect of the present embodiment can be obtained. Examples of other layers include a reinforcing layer.

The reinforcing layer is a layer for enhancing the mechanical strength of the fixing belt 61, and is disposed, for example, on a surface (the inner peripheral surface of the base layer 61*a*) opposite to the elastic layer 61*b* and the surface layer 61*c* of the fixing belt 61. The reinforcing layer can be made of the above-described heat-resistant resin, and a thickness thereof can be appropriately determined.

The fixing belt 61 can be manufactured by using a known method for manufacturing a laminated fixing belt. For example, the fixing belt 61 can be manufactured by a method including covering an outer surface of an endless molded body made of a heat-resistant resin which is the base layer 61*a* with a tube which is the surface layer (release layer) 61*c*, injecting the elastic layer material or a precursor thereof between the molded body and the tube, and heating and curing the elastic layer material or the precursor as necessary.

Regarding the reason why the effects of the invention described above can be obtained by the image forming method according to the embodiment of the present invention and the image forming apparatus according to an embodiment of the present invention, an expression mechanism and an action mechanism thereof have not been clarified but are estimated as follows.

<Mechanism of Obtaining Image with Low Gloss and Image with High Gloss with Integrated Fixing Belt>

For the fixing belt (also referred to as a belt 1) having the elastic layer containing the elastic layer material whose storage elastic modulus at 200° C. exceeds the upper limit ($2.5\times10^6$ Pa) of the range of the present invention, FIG. 4 shows a graph indicating the relationship between the fixing temperature (the surface temperature of the fixing belt) and the gloss. As is apparent from FIG. 4, the graph does not have an inflection point, and the behavior (see the belt 1 in FIG. 4) of increasing the gloss of the image formed by increasing the fixing temperature in the entire range (140° C. to 195° C.) of the fixing temperature is shown.

For the fixing belt (also referred to as a belt 3) having the elastic layer containing the elastic layer material whose storage elastic modulus at 200° C. is less than the lower limit ($1.0\times10^6$ Pa) of the range of the present invention, FIG. 4 shows a graph indicating the relationship between the fixing temperature (the surface temperature of the fixing belt) and the gloss. As is apparent from FIG. 4, the graph does not have an inflection point, and the behavior (see the belt 3 in FIG. 4) of hardly increasing the gloss of the image formed by increasing the fixing temperature in the entire range (152° C. to 185° C.) of the fixing temperature is shown.

On the other hand, for the fixing belt (also referred to as a belt 2) having the elastic layer containing the material whose storage elastic modulus at 200° C. is in the range of the present invention, FIG. 4 shows the graph indicating the relationship between the fixing temperature (the surface temperature of the fixing belt) and the gloss. As is apparent from FIG. 4, the graph has an inflection point, and shows the behavior of hardly increasing the gloss of the image formed by increasing the fixing temperature (the surface temperature of the fixing belt) before the inflection point and shows the behavior of increasing the gloss of the image formed by increasing the fixing temperature after the inflection point (see the belt 2 in FIG. 4). That is, the fixing belt (belt 2) according to the embodiment of the present invention can be combined with a toner having a specific storage elastic modulus, and thus the change in the gloss of both the belt 3 and the belt 1 is shown by one fixing belt.

Here, the toner used for the measurement of the gloss in FIG. 4 is the toner of Example 1 which satisfies the requirements of the present invention in which the storage elastic modulus is $2.0\times10^6$ Pa or more at 70° C. and $4.0\times10^4$ Pa or less at 90° C.

In addition, the characteristics of the belt 3 shown in FIG. 4 are considered to be exhibited because the belt 3 does not rub between the toner and the fixing belt and is simply pressed to make the gloss change due to the temperature change small. On the other hand, the characteristics of the belt 1 shown in FIG. 4 are considered to be exhibited because a shearing force is exerted between the toner and the fixing belt and a phenomenon of increasing gloss due to the spread of the toner occurs. Therefore, the reason why the inflection point is generated by the combination of the fixing belt (belt 2) and the toner according to the embodiment of the present invention is considered that the fixing belt is easy to slide since the melting of the toner is progressed by heating before the inflection point and the fixing belt is in a sliding state after the inflection point.

Figure 5:
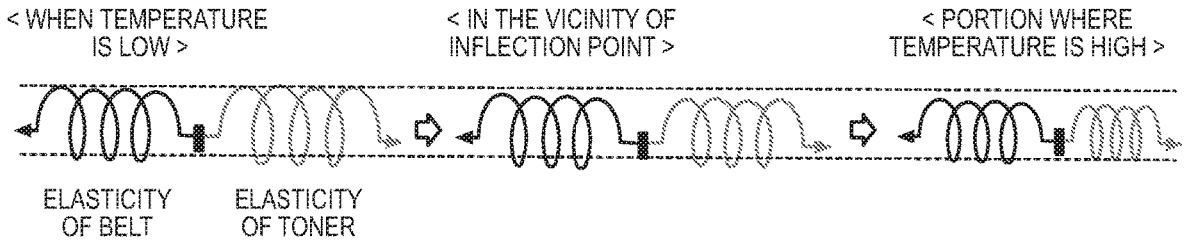
FIG. 5 is a diagram schematically showing elastic changes in the fixing belt and the toner according to the embodiment of the present invention due to pulling of a spring when the fixing temperature is below an inflection point shown in FIG. 4, at the fixing temperature in the vicinity of the inflection point, and when the fixing temperature is above the inflection point.

FIG. 5 is a diagram schematically showing the elastic change of the fixing belt and the toner according to the embodiment of the present invention according to the pulling of the spring. As shown in FIG. 5, considering the pulling of the spring between the fixing belt and the toner according to the embodiment of the present invention, the spring at the toner portion is strong at a low temperature. However, as the temperature is raised, both springs become weaker. Since the weakening degree of the spring due to the difference in the storage elastic modulus of the elastic layer material and toner is larger in the toner portion, the spring in the fixing belt (in particular, elastic layer) is strong in the case of exceeding the inflection point, and the toner is spread.

Specifically, when the unfixed toner image is fixed to the recording material S at the fixing nip portion, the fixing belt 61 including the elastic layer has already been heated to the fixing temperature. Therefore, it is considered that the storage elastic modulus of the elastic layer of the fixing belt at 200° C. affects gloss. On the other hand, since the toner is not heated at this point, it is considered that the storage elastic modulus of the toner from 70° C. to 90° C. estimated as the temperature of the toner near the inlet of the fixing nip portion affects gloss. From this viewpoint, in the present embodiment, the fixing belt in which the storage elastic modulus of the elastic layer material at 200° C. is in the specified range is combined with the toner in which the storage elastic modulus at 70° C. and 90° C. is in the specified range. As a result, it is possible to stably obtain the image with low gloss and the image with high gloss only by changing the fixing temperature, for example, from 5 to 20° C. and preferably from 10 to 15° C. before and after the inflection point. More specifically, the fixing temperature is changed to be, for example, (inflection point—3° C.) to (inflection point—10° C.) and (inflection point+3° C.) to (inflection point+10° C.) and preferably (inflection point—5° C.) to (inflection point—8° C.) and (inflection point+5° C.) to (inflection point+8° C.) before and after the inflection point. More specifically, as shown in FIG. 4, if the inflection point is 180° C., the fixing temperature is changed to be 177° C. to 170° C. before the inflection point and 183° C. to 190° C. after the inflection point, and preferably 175° C. to 172° C. before the inflection point and 185° C. to 188° C. after the inflection point. As a result, it is considered that it is possible to stably obtain the image with low gloss and the image with high gloss.

The expression mechanism and the action mechanism are based on the speculation, and the present invention is not limited to the above mechanism.

(Configuration of Toner)

The toner according to the embodiment of the present invention has the storage elastic modulus of $2.0\times10^6$ Pa or more at 70° C. and $4.0\times10^4$ Pa or less at 90° C. By combining the fixing belt according to the present invention by using such a toner having the storage elastic modulus in the specific range, it is possible to stably obtain the image with low gloss and the image with high gloss only by changing the fixing temperature, for example, from 10° C. to 15° C. As described above, according to the image forming method of the embodiment of the present invention, it is possible to simply form the image with high gloss and the image with low gloss only by hardly changing the fixing temperature. Therefore, it is possible to avoid increasing the size and cost of the image forming apparatus and it is possible to form an image having various glosses according to the user's request only by changing the fixing temperature in multiple stages. When the storage elastic modulus of the toner is less than $2.0\times10^6$ Pa at 70° C., even when the toner is combined with the fixing belt according to the present invention, it is possible to express the high gloss only by changing the fixing temperature, but not to sufficiently express the low gloss. Therefore, it is not preferable because the image with high gloss and the image with low gloss cannot be freely formed (see Comparative Example 4). On the other hand, when the storage elastic modulus of the toner exceeds $4.0\times10^4$ Pa at 90° C., even when the toner is combined with the fixing belt according to the present invention, it is possible to express the low gloss only by changing the fixing temperature, but not to sufficiently express the high gloss. Therefore, it is not preferable because the image with high gloss and the image with low gloss cannot be freely formed (see Comparative Example 3). Regarding the relationship between the storage elastic modulus and the gloss of these toners, it is considered that if the storage elastic modulus at 70° C. is lower than $2.0\times10^6$ Pa, the shear is likely to occur, so that the gloss is increased, and if the storage elastic modulus at 90° C. exceeds $4.0\times10^4$ Pa, the shear is less likely to occur, so the gloss is decreased. From this viewpoint, the storage elastic modulus of the toner according to the present invention is preferably $2.5\times10^6$ Pa or more and $4.0\times10^6$ Pa or less, more preferably $2.8\times10^6$ Pa or more and $3.5\times10^6$ Pa or less, still more preferably exceeds $2.8\times10^6$ Pa and is less than $3.5\times10^6$ Pa, particularly preferably $2.8\times10^6$ Pa or more and $3.4\times10^6$ Pa or less, particularly preferably $2.9\times10^6$ Pa or more and $3.3\times10^6$ Pa or less, and particularly preferably $3.0\times10^6$ Pa or more and $3.2\times10^6$ Pa or less at 70° C. In addition, the storage elastic modulus of the toner according to the present invention is preferably $4.0\times10^4$ Pa or less, more preferably $3.7\times10^4$ Pa or less, still more preferably $3.4\times10^4$ Pa or less, particularly preferably $3.2\times10^4$ Pa or less, particularly preferably $3.0\times10^4$ Pa or less, and particularly preferably $2.8\times10^4$ Pa or less at 90° C. If the storage elastic modulus at 90° C. is decreased, the toner is easy to be melted, so the gloss tends to be increased. Therefore, it can be said that the lower limit of the storage elastic modulus at 90° C. does not need to be specifically defined from the viewpoint of sufficiently express the high gloss.

The storage elastic modulus at 70° C. and 90° C. of the toner is an index indicating the hardness as a viscoelastic body of the toner and is a value obtained by the measuring method described in Examples described later. The storage elastic modulus of the toner can be adjusted, for example, by a glass transition temperature (Tg), a molecular weight, a composition ratio, and polarity of an amorphous resin such as vinyl resin which is a main component of a binder resin, and by an amount, polarity, a melting point, and a hybrid ratio (a content ratio of an amorphous polymerization segment in a crystalline resin) of a crystalline resin. Describing a styrene acrylic resin particularly suitable among the amorphous resins as an example, in a content mass ratio of constituent units derived from a styrene monomer and each constituent unit derived from a (meth)acrylic acid ester monomer in the resin, the content mass ratio of the constituent units derived from the styrene monomer is increased, and if the content mass ratio of the constituent units derived from the (meth)acrylic acid ester monomer is decreased, the value of the storage elastic modulus at 70° C. tends to be increased and the value of the storage elastic modulus at 90° C. tends to be decreased (see Examples 3 to 5 in Table 5). In addition, the storage elastic modulus of the toner can also be adjusted by the amount, polarity, melting point and the like of the wax. For example, if the melting point of the wax in the toner base particles is high, the value of the storage elastic modulus at 90° C. tends to be increased (see Examples 3, 6, and 7). The polarity of the main component of the binder resin can be adjusted depending on a type of the monomer. For example, if the amorphous resin is a vinyl resin, the polarity can be easily adjusted by using a monomer having a structure similar to that of the crystalline resin monomer. In addition, the polarity, melting point and hybrid ratio of the crystalline resin can be adjusted according to a type of crystalline resin. Similarly, the polarity and melting point of the wax can also be adjusted by a type of wax. Specifically, as the Tg and the molecular weight of the main component (the amorphous resin such as the vinyl resin) of the binder resin are increased, the value of the storage elastic modulus tends to be increased. In addition, as the difference in polarity between the crystalline resin and the amorphous resin is increased, these components are incompatible with each other, and the value of the storage elastic modulus tends to be increased. In addition, as the amount of the crystalline resin relative to the toner base particles is increased, the values of the storage elastic modulus of both 70° C. and 90° C. tend to be decreased (see Example 2 and Comparative Example 3), and as the amount of wax with respect to the toner base particles is increased, the values of storage elastic modulus at both 70° C. and 90° C. tend to be decreased (see Examples 1 and 2). In addition, as the weight average molecular weight of the crystalline polyester resin in the binder resin is increased, the storage elastic modulus is increased. In addition, as the styrene-acrylic modification ratio of the crystalline polyester resin is increased, the storage elastic modulus is increased.

The configuration of the toner other than the requirement of the storage elastic modulus is not particularly limited, and the conventionally known configuration of the toner can be appropriately selected and used. Hereinafter, the representative configuration of the toner will be described below, but the present invention is not limited thereto.

The toner according to the embodiment of the present invention is a toner for developing an electrostatic latent image and may be a one-component developer or a two-component developer in a range in which the above-described specific storage elastic modulus is satisfied. The one-component developer is composed only of toner particles, and the two-component developer is composed of toner particles and carrier particles. The toner particles are composed of toner base particles and external additives adhering to the surfaces thereof. The toner can be prepared by using a known method using a known compound as a toner material.

It is preferable that the toner base particles contain the binder resin and the wax. The binder resin preferably contains a crystalline resin, and contains more preferably a crystalline resin and an amorphous resin. As the amorphous resin, it is preferable to contain a vinyl resin. As the crystalline resin, it is preferable to contain a crystalline polyester resin. This is because sufficient low temperature fixability and gloss uniformity can be obtained.

The crystalline resin is not a stepwise endothermic change in DSC, but is referred to as a resin having a definite endothermic peak. Specifically, the definite endothermic peak means a peak where a half value width of an endothermic peak is within 15° C. when measured at a ramp rate of 10° C./min in DSC.

The crystalline resin may be one type or more. The melting point (Tmc) of the crystalline resin is preferably 60° C. or more from the viewpoint of obtaining sufficiently high temperature storability, and is preferably 85° C. or less from the viewpoint of obtaining sufficient low temperature fixability.

The melting point (Tmc) of the crystalline resin can be measured by the DSC. Specifically, 0.5 mg of a sample of a crystalline resin is enclosed in an aluminum pan "KIT-NO.B0143013" and set in a sample holder of a thermal analyzer "Diamond DSC" (manufactured by PerkinElmer, Inc.), and a temperature thereof is changed in order of heating, cooling, and heating. During the first heating and the second heating, the temperature is raised from room temperature (25° C.) to 150° C. at a ramp rate of 10° C./min and is kept at 150° C. for 5 minutes, and during the cooling, the temperature falls from 150° C. to 0° C. at a cooling rate of 10° C./min and is kept at 0° C. for 5 minutes. The temperature at the peak top of the endothermic peak in the endothermic curve obtained at the second heating is measured as the melting point (Tmc).

The melting point of the toner base particles is determined by the crystalline resin in the toner base particles. Therefore, when the toner base particles contain two or more types of crystalline resins, the melting point of the toner base particles usually becomes the higher melting point of the melting points of two or more types of crystalline resins. The melting point (furthermore, the melting point Tmc of the crystalline resin) of the toner base particles can be adjusted by the combination of the molecular weight of the crystalline resin and the monomer. For example, as the number of carbon atoms of monomers is increased, the melting point tends to be high. Similar to the melting point (Tmc) of the crystalline resin, the melting point of the toner base particles can also be measured using the known thermal analysis apparatus (DSC apparatus), for example, "Diamond DSC" manufactured by PerkinElmer, Inc., using toner particles or toner base particles as a sample.

The content of the crystalline resin with respect to the toner base particles is preferably 2 mass % or more and 20 mass % or less, and more preferably 7 mass % or more and 15 mass % or less from the viewpoint of obtaining sufficient low temperature fixability. The case in which the content of the crystalline resin is 2 mass % or more is preferable because the sufficient plasticizing effect is obtained and the low temperature fixability is sufficient. The case in which the content of the crystalline resin is 20 mass % or less is preferable because the thermal stability as a toner or the stability against a physical stress is sufficient. In the above preferred or more preferred range, it is easier to control the preferred storage elastic modulus by selecting, for example, the amorphous resin composition or the appropriate preparing method.

The crystalline resin may be one type or more. Examples of the crystalline resin include a polyolefin-based resin, a polydienic-based resin, and a polyester-based resin. The crystalline resin is preferably a crystalline polyester resin from the viewpoint of achieving the sufficient low temperature fixability and the gloss uniformity.

The weight average molecular weight (Mw) of the crystalline resin is preferably 3,000 or more and 100,000 or less, more preferably 4,000 or more and 50,000 or less, and particularly preferably 5,000 or more and 30,000 or less. In addition, the number average molecular weight (Mn) of the crystalline resin is preferably 8,500 or more and 12,500 or less, and more preferably 9,000 or more and 11,000 or less. If the above Mw and Mn are too small, the strength of the fixed image becomes insufficient, the crystalline resin is pulverized during the stirring of an emulsified liquid, or the glass transition temperature (Tg) of the toner may be lowered due to excessive plasticizing effect to lower the thermal stability of the toner. In addition, if the Mw and Mn are too large, sharp melt property is hard to appear and the fixing temperature may become too high. The Mw and Mn can be obtained from the molecular weight distribution measured by gel permeation chromatography (GPC).

The sample is added to tetrahydrofuran (THF) so as to be a concentration of 0.1 mg/mL, heated to 40° C. so as to be dissolved, and then treated with a membrane filter having a pore size of 0.2 μm, thereby preparing a sample solution. By using a GPC apparatus HLC-8220GPC (manufactured by Tosoh Corporation) and a column "TSKgel Super H3000" (manufactured by Tosoh Corporation), the THF flows at a flow rate of 0.6 mL/min as a carrier solvent while the column temperature is kept at 40° C. 100 μL of the prepared sample solution is injected into the GPC apparatus along with the carrier solvent, and the sample was detected using a differential refractive index detector (RI detector). The molecular weight distribution of the sample is calculated by using an analytical curve measured using 10 points of mono-dispersibility polystyrene standard particles. In this case, if the peak caused by the filter is confirmed in the data analysis, the area before the peak is set as a baseline.

The crystalline polyester resin is obtained by a polycondensation reaction of divalent or higher carboxylic acid (polycarboxylic acid) with divalent or higher alcohol (polyhydric alcohol).

Examples of the polycarboxylic acid include a dicarboxylic acid. The dicarboxylic acid may be one type or more. The dicarboxylic acid is preferably an aliphatic dicarboxylic acid and may further contain an aromatic dicarboxylic acid. The aliphatic dicarboxylic acid is preferably a straight chain type, which is preferable from the viewpoint of increasing the crystallinity of the crystalline polyester resin.

Examples of the aliphatic dicarboxylic acid include oxalic acid, malonic acid, succinic acid, glutaric acid, adipic acid, pimelic acid, sebacic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, 1,18-octadecanedicarboxylic acid, lower alkyl esters thereof, acid anhydrides thereof and the like. Among those, from the viewpoint of achieving the effects of both the low temperature fixability and transferability, an aliphatic dicarboxylic acid having 6 or more carbon atoms and 16 or less carbon atoms is preferable, and an aliphatic dicarboxylic acid having 10 or more carbon atoms and 14 or less carbon atoms is more preferable.

Examples of the aromatic dicarboxylic acids include terephthalic acid, isophthalic acid, orthophthalic acid, t-butylisophthalic acid, 2,6-naphthalene dicarboxylic acid, and 4,4'-biphenyl dicarboxylic acid. Among those, from the viewpoint of easiness of acquisition and emulsification, terephthalic acid, isophthalic acid, or t-butylisophthalic acid is preferable.

The content of the constituent unit derived from the aliphatic dicarboxylic acid with respect to the constituent unit derived from the dicarboxylic acid in the crystalline polyester resin is preferably 50 mol % or more, more preferably 70 mol % or more, still more preferably 80 mol % or more, and particularly preferably 100 mol %, from the viewpoint of securing the sufficient crystallinity of the crystalline polyester resin.

Examples of the polyhydric alcohol component include diol. The diol may be one type or more, and as the diol, an aliphatic diol may be preferably used and diols other than the aliphatic diol may be further included. The aliphatic diol is preferably a straight chain type from the viewpoint of increasing the crystallinity of the crystalline polyester resin.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among those, from the viewpoint of achieving the effects of both the low temperature fixability and transferability, aliphatic diol having 2 or more carbon atoms and 12 or less carbon atoms is preferable, and aliphatic diol having 4 or more carbon atoms and 12 or less carbon atoms is more preferable.

Examples of other diols include diols having a double bond and diols having a sulfonic acid group. Specific examples of diols having a double bond include 2-butene-1,4-diol, 3-butene-1,6-diol, and 4-butene-1,8-diol.

The content of the constituent unit derived from the aliphatic diol with respect to the constituent unit derived from the diol in the crystalline polyester resin is preferably 50 mol % or more, more preferably 70 mol % or more, still more preferably 80 mol % or more, and particularly preferably 100 mol %, from the viewpoint of increasing the low temperature fixability of the toner and the gloss of the image finally formed.

The ratio of the diol to the dicarboxylic acid in the monomer of the crystalline polyester resin is preferably 2.0/1.0 or more and 1.0/2.0 or less in an equivalence ratio [OH]/[COOH] of a hydroxyl group [OH] of diol and a carboxy group [COOH] of dicarboxylic acid, more preferably 1.5/1.0 or more and 1.0/1.5 or less, and particularly preferably 1.3/1.0 or more and 1.0/1.3 or less.

From the viewpoint of maintaining the crystallinity of the crystalline polyester resin in the toner, the monomer constituting the crystalline polyester resin preferably contains 50 mass % or more of linear aliphatic monomer and more preferably 80 mass % or more of linear aliphatic monomer. In the case of using the aromatic monomer, the melting point of the crystalline polyester resin tends to be increased and in the case of using the branched aliphatic monomer, the crystallinity tends to be decreased. Therefore, the monomer constituting the crystalline polyester resin particularly preferably contains the 50 mass % or more of linear aliphatic monomer.

The crystalline polyester resin can be synthesized by the polycondensation (esterification) of polycarboxylic acid and polyhydric alcohol using the known esterification catalysts.

Examples of the catalyst which can be used in the synthesis of the crystalline polyester resin include one type or more, and examples thereof include alkaline metal compounds such as sodium and lithium, compounds containing a Group 2 element such as magnesium and calcium, metal compounds such as aluminum, zinc, manganese, antimony, titanium, tin, zirconium, and germanium, a phosphorus acid compound, a phosphoric acid compound, an amine compound, and the like.

Specifically, examples of the tin compound include dibutyltin oxide, tin octylate, tin dioctyltin, salts thereof, and the like. Examples of the titanium compounds include titanium alkoxide such as tetranolmalbutyl titanate, tetraisopropyl titanate, tetramethyl titanate, and tetrastearyl titanate, titanium acylate such as polyhydroxy titanium stearate, titanium chelate such as titanium tetraacetylacetonate, titanium lactate, and titanium triethanolaminate, and the like. Examples of the germanium compounds include germanium dioxide, and examples of the aluminum compounds include oxides such as polyaluminum hydroxide, aluminum alkoxides, tributyl aluminates, and the like.

The polymerization temperature of the crystalline polyester resin is preferably 150° C. or more and 250° C. or less. In addition, the polymerization time is preferably 0.5 hours or more and 10 hours or less. During the polymerization, the pressure in the reaction system may be reduced.

The amorphous resin is a resin having no crystallinity as described above. For example, when the differential scanning calorimetry (DSC) is performed, the amorphous resin is a resin which has no melting point and has a relatively high glass transition temperature (Tg).

The Tg of the amorphous resin is preferably 35° C. or more and 80° C. or less, and more preferably 45° C. or more and 65° C. or less. In particular, from the viewpoint of facilitating the compatibility between the heat resistance (for example, high temperature storability) and the low temperature fixability, it is preferable that the toner base particles have a core-shell structure. In addition, when a core of a core-shell structure contains particles of a wax-containing amorphous resin (for example, a wax-containing amorphous vinyl resin) having a three-layer structure, the Tg of the amorphous resin constituting the outermost layer of the particles is preferably in the range of 55° C. or more and 65° C. or less, from the viewpoint of more reliably achieving the fixability such as the low temperature fixability and the heat resistance such as heat resistant storage property and blocking resistance.

The glass transition temperature can be measured by the DSC method prescribed in ASTM D 3418-82. For the measurement, a DSC-7 differential scanning calorimeter (manufactured by PerkinElmer, Inc.), a TACT/DX thermal analyzer controller (manufactured by PerkinElmer, Inc.), or the like can be used.

The amorphous resin may be one type or more. Examples of the amorphous resins include amorphous polyester resins such as a vinyl resin, a urethane resin, a urea resin, and a styrene-acrylic modified polyester resin. In this embodiment, it is preferable that the amorphous resin contains a vinyl resin from the viewpoint of facilitating the control of thermoplasticity.

The vinyl resin is, for example, a polymer of a vinyl compound, and examples thereof include an acrylic acid ester resin, a styrene-acrylic acid ester resin, and an ethylene-vinyl acetate resin. Among those, the styrene-acrylic acid ester resin (also referred to as a styrene acrylic resin) is preferable from the viewpoint of the plasticity upon the thermal fixation.

The styrene acrylic resin is formed by addition polymerization of at least a styrene monomer and a (meth)acrylic acid ester monomer. In addition to styrene represented by a structural formula of $CH_2{=}CH{-}C_6H_5$, the styrene monomer includes a styrene derivative having a known side chain or a functional group in the styrene structure.

In addition, the (meth)acrylic acid ester monomer includes an acrylic acid ester derivative or a methacrylic acid ester derivative having a known side chain or a functional group in the structure of these esters in addition to acrylic acid ester or methacrylic acid ester represented by $CH(R^1){=}CHCOOR^2$ ($R^1$ represents a hydrogen atom or a methyl group, and $R^2$ represents an alkyl group having 1 or more to 24 or less carbon atoms).

Examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene and the like.

Examples of the (meth)acrylic acid ester monomer include an acrylic acid ester monomer such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; a methacrylic acid ester monomer such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethyl aminoethyl methacrylate, and the like.

In the present specification, the "(meth)acrylic acid ester monomer" is a generic name for "acrylic acid ester monomer" and "methacrylic acid ester monomer", and means one or both of them. For example, the "(meth)acrylic acid methyl" means one or both of "methyl acrylate" and "methyl methacrylate".

The (meth)acrylic acid ester monomer may be one type or more. For example, it is possible to form any of a copolymer using a styrene monomer and two or more types of acrylic acid ester monomers, a copolymer using a styrene monomer and two or more types of methacrylic acid ester monomers, and a copolymer using a styrene monomer together with an acrylic acid ester monomer and a methacrylic acid ester monomer.

From the viewpoint of controlling the plasticity of the amorphous resin, the content of the constituent unit derived from the styrene monomer in the amorphous resin is preferably 40 mass % or more and 90 mass % or less. In addition, the content of the constituent unit derived from the (meth)acrylic acid ester monomer in the amorphous resin is preferably 10 mass % or more and 60 mass % or less.

The amorphous resin may further contain a constituent unit derived from a monomer other than the styrene monomer and the (meth)acrylic acid ester monomer. Other monomers are preferably a compound which is ester-bonded to a hydroxy group (—OH) derived from a polyhydric alcohol or a carboxy group (—COOH) derived from a polycarboxylic acid. That is, the amorphous resin is preferably a polymer which can be addition polymerized with the styrene monomer and the (meth)acrylic acid ester monomer, and which is obtained by additionally polymerizing a compound (amphoteric compound) having a carboxy group or a hydroxy group.

Examples of the amphoteric compound include compounds having a carboxy group such as acrylic acid, methacrylic acid, maleic acid, itaconic acid, cinnamic acid, fumaric acid, maleic acid monoalkyl ester, and itaconic acid monoalkyl ester, and compounds having a hydroxy group such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono (meth)acrylate.

The content of the constituent unit derived from the amphoteric compound in the amorphous resin is preferably 0.5 mass % or more and 20 mass % or less.

The styrene acrylic resin can be synthesized by a method of polymerizing a monomer using a known oil-soluble or water-soluble polymerization initiator. Examples of the oil-soluble polymerization initiator include an azo-based or diazo-based polymerization initiators and a peroxide polymerization initiator.

Examples of the azo-based or diazo-based polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide-based polymerization initiator include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl) propane, and tris-(t-butylperoxy) triazine.

In addition, when the resin particles of the styrene acrylic resin are synthesized by an emulsion polymerization method, the water-soluble radical polymerization initiator can be used as the polymerization initiator.

Examples of the water-soluble polymerization initiator include persulfates such as potassium persulfate and ammonium persulfate, azobisaminodipropane acetate, azobiscyanovaleric acid and salts thereof, and hydrogen peroxide.

From the viewpoint of easily controlling the plasticity of the amorphous resin, the number average molecular weight (Mn) of the amorphous resin is preferably 5,000 or more and 150,000 or less, and more preferably 10,000 or more and 70,000 or less.

The structure and constituent monomers of the crystalline resin affect the degree of crystallinity and the melting calorie of the crystalline resin. From the viewpoint of adjusting the crystallinity of the crystalline resin to a preferable range for the fixing, the crystalline resin is preferably a hybrid crystalline polyester resin (hereinafter, also simply referred to as "hybrid resin"). The hybrid resin may be one type or more. In addition, the hybrid resin may be used in place of the whole amount of the crystalline polyester resin, and a part thereof may be replaced and used.

The hybrid resin is a resin in which a crystalline polyester polymerization segment (also referred to as a polyester resin segment) and a polymerization segment (also referred to as another polymerization segment or a resin segment) other than the crystalline polyester are chemically bonded. In the present embodiment, the hybrid resin is a resin in which the crystalline polyester polymerization segment and the amorphous polymerization segment are chemically bonded. The crystalline polyester polymerization segment means a portion derived from the crystalline polyester resin. That is, it means a molecular chain having the same chemical structure as a molecular chain constituting the above-described crystalline polyester resin. In addition, the amorphous polymerization segment means a portion derived from the amorphous resin. That is, it means a molecular chain having the same chemical structure as a molecular chain constituting the above-described amorphous resin.

The Mn of the hybrid resin is preferably 5,000 or more and 100,000 or less, more preferably 7,000 or more and 50,000 or less, and particularly preferably 8,000 or more and 20,000 or less, from the viewpoint of reliably achieving both the sufficient low temperature fixability and the excellent long-term storage stability. By setting the Mn of the hybrid resin to 100,000 or less, it is possible to obtain the sufficient low temperature fixability. On the other hand, by setting the Mn of the hybrid resin to 5,000 or more, it is possible to suppress the compatibility between the hybrid resin and the amorphous resin from being excessively progressed at the time of storing the toner and effectively suppress an image defect due to fusing between the toners.

The crystalline polyester polymerization segment may be, for example, a resin having a structure in which other components are copolymerized with the main chain of the crystalline polyester polymerization segment, or a resin having a structure in which the crystalline polyester polymerization segment is copolymerized with a main chain composed of other components. The crystalline polyester polymerization segment can be synthesized from the above-described polycarboxylic acid and polyhydric alcohol in the same manner as the above-described crystalline polyester resin.

From the viewpoint of imparting sufficient crystallinity to the hybrid resin, the content of the crystalline polyester polymerization segment in the hybrid resin is preferably 80 mass % or more and less than 98 mass %, and more preferably 90 mass % or more and less than 95 mass %. The constituent components and the content of each segment in the hybrid resin or in the toner can be specified, for example, by using the known analysis method such as nuclear magnetic resonance (NMR) and methylation reaction pyrolysis gas chromatography/mass spectrometry (P-GC/MS).

It is preferable that the crystalline polyester polymerization segment further includes a monomer having an unsaturated bond from the viewpoint of introducing a chemical bonding site with the amorphous polymerization segment into the segment. A monomer having an unsaturated bond is, for example, a polycarboxylic acid or a polyhydric alcohol having a double bond, and examples thereof include polycarboxylic acids having a double bond such as methylene succinic acid, fumaric acid, maleic acid, 3-hexene dioic acid, and 3-octenedioic acid, and a polyhydric alcohol having a double bond such as 2-butene-1,4-diol, 3-butene-1,6-diol, and 4-butene-1,8-diol. The content of the constituent unit derived from the unsaturated bond-containing monomer in the crystalline polyester polymerization segment is preferably 0.5 mass % or more and 20 mass % or less.

The hybrid resin may be a block copolymer or a graft copolymer. However, the graft copolymer is preferred from the viewpoint of easily controlling the sufficient orientation of the crystalline polyester polymerization segment and imparting the sufficient crystallinity to the hybrid resin. Further, it is preferable that the hybrid resin is grafted in a comb shape with the polymerization segment other than the polyester resin as a main chain and the polyester polymerization segment as a side chain. That is, the hybrid resin is preferably the graft copolymer having the amorphous polymerization segment as a main chain and the crystalline polyester polymerization segment as a side chain.

Functional groups such as a sulfonic acid group, a carboxy group, and a urethane group may be further introduced into the hybrid resin. The introduction of the functional group may be in the crystalline polyester polymerization segment or in the amorphous polymerization segment.

The amorphous polymerization segment enhances the affinity between the amorphous resin constituting the binder resin and the hybrid resin. As a result, the hybrid resin is easily taken into the amorphous resin, and the charging uniformity of the toner is further improved. The constituent components and the content of the amorphous polymerization segment in the hybrid resin or in the toner can be specified, for example, by using the known analysis method such as the NMR or the P-GC/MS.

In addition, similar to the amorphous resin described above, the glass transition temperature (Tg) of the amorphous polymerization segment in the first heating process of the DSC is preferably 30° C. or more and 80° C. or less and more preferably from 40° C. or more and 65° C. or less. The glass transition temperature (Tg) can be measured by the method described above.

The amorphous polymerization segment is preferably composed of the same type of resin as the amorphous resin contained in the binder resin from the viewpoint of enhancing the affinity with the binder resin and enhancing the charging uniformity of the toner. By adopting such a form, the affinity between the hybrid resin and the amorphous resin is further improved. "The same type of resin" means resins having a characteristic chemical bond in a repeating unit.

The "characteristic chemical bonds" depends on "polymer classification" as described in National Institute for Materials Science (NIMS) substance and materials database (http://polymer.nims.go.jp/PoLyInfo/guide/jp/term_polymer.html). That is, the chemical bond constituting polymers classified into a total of 22 types such as polyacrylic, polyamide, polyanhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl, and other polymers is referred to as a "characteristic chemical bond".

In addition, in the case where the resin is a copolymer, "the same type of resin" means resins commonly having the characteristic chemical bond in the case where a type of monomer having the above chemical bond is used as a constituent unit in the chemical structure of plural types of monomer constituting the copolymer.

Therefore, even when the properties of the resins themselves are different from each other or the molar component ratios of the type of monomer constituting the copolymer are different from each other, these resins are regarded as the same type of resin as long as they commonly have the characteristic chemical bond.

For example, a resin (or polymerization segment) formed by styrene, butyl acrylate, and acrylic acid and a resin (or polymerization segment) formed by styrene, butyl acrylate, and methacrylic acid have a chemical bond at least constituting polyacrylic, and therefore these resins are the same type of resin. By way of further illustration, the resin (or polymerization segment) formed by styrene, butyl acrylate, and acrylic acid and the resin (or polymerization segment) formed by styrene, butyl acrylate, acrylic acid, terephthalic acid, and fumaric acid has, as a chemical bond common to each other, a chemical bond at least constituting polyarcylic. Therefore, these resins are the same type of resin.

Examples of the amorphous polymerization segment include a styrene-acrylic polymerization segment, a vinyl polymerization segment, a urethane polymerization segment, and a urea polymerization segment. Among those, from the viewpoint of ease of controlling the thermoplasticity, the amorphous polymerization segment is preferably a vinyl polymerization segment. The vinyl polymerization segment can be synthesized in the same manner as the vinyl resin described above.

The content of the constituent unit derived from the styrene monomer in the amorphous polymerization segment is preferably 40 mass % or more and 90 mass % or less from the viewpoint of easily controlling the plasticity of the hybrid resin. In addition, from the same viewpoint, the content of the constituent unit derived from the (meth) acrylic acid ester monomer in the amorphous polymerization segment is preferably 10 mass % or more and 60 mass % or less.

In addition, it is preferable in amorphous polymerization segment that the amphoteric compound described above is further included in a monomer from the viewpoint of introducing the chemical bonding site with the crystalline polyester polymerization segment into the amorphous polymerization segment. The content of the constituent unit derived from the amphoteric compound in the amorphous polymerization segment is preferably 0.5 mass % or more and 20 mass % or less.

From the viewpoint of imparting the sufficient crystallinity to the hybrid resin, the content of the amorphous polymerization segment in the hybrid resin is preferably 3 mass % or more and less than 15 mass %, more preferably 5 mass % or more and less than 10 mass %, and still more preferably 7 mass % or more and less than 9 mass %.

The hybrid resin can be prepared, for example, by the first to third preparing methods described below.

The first preparing method is a method of preparing a hybrid resin by performing a polymerization reaction synthesizing a crystalline polyester polymerization segment in the presence of a previously synthesized amorphous polymerization segment.

In this method, first, the amorphous polymerization segment is synthesized by the addition reaction of the monomers constituting the amorphous polymerization segment described above. Next, in the presence of the amorphous polymerization segment, the polycarboxylic acid and the polyhydric alcohol are polymerized to synthesize the crystalline polyester polymerization segment. At this time, the condensation reaction of the polycarboxylic acid and the polyhydric alcohol and the addition reaction of the polycarboxylic acid or the polyhydric alcohol to the amorphous polymerization segment are performed to synthesize the hybrid resin.

In the first preparing method described above, it is preferable to incorporate the sites where these segments can react with each other in the crystalline polyester polymerization segment or the amorphous polymerization segment. Specifically, at the time of the synthesis of the amorphous polymerization segment, in addition to the monomer constituting the amorphous polymerization segment, the above-described amphoteric compound is also used. The amphoteric compound reacts with a carboxy group or a hydroxy group in the crystalline polyester polymerization segment, so the crystalline polyester polymerization segment is chemically and quantitatively bonded to the amorphous polymerization segment. In addition, at the time of synthesizing the crystalline polyester polymerization segment, the monomer may further contain the compound having the unsaturated bond described above.

According to the first preparing method, it is possible to synthesize the hybrid resin having a structure (graft structure) in which the crystalline polyester polymerization segment is chemically bonded to the amorphous polymerization segment.

The second preparing method is a method in which the crystalline polyester polymerization segment and the amorphous polymerization segment are each formed and are bonded to prepare the hybrid resin.

In this method, first, the crystalline polyester polymerization segment is synthesized by the condensation reaction of the polycarboxylic acid and the polyhydric alcohol. In addition, apart from the reaction system synthesizing the crystalline polyester polymerization segment, the amorphous polymerization segment is synthesized by the addition polymerization of the monomer constituting the amorphous polymerization segment described above. At this time, it is preferable to incorporate sites where the crystalline polyester polymerization segment and the amorphous polymerization segment can react with each other in one or both of the crystalline polyester polymerization segment and the amorphous polymerization segment, as described above.

Next, it is possible to synthesize the hybrid resin having the structure in which the crystalline polyester polymerization segment and the amorphous polymerization segment are chemically bonded by allowing the synthesized crystalline polyester polymerization segment to react with the amorphous polymerization segment.

In addition, in the case where the reactive site is not incorporated in any of the crystalline polyester polymerization segment and the amorphous polymerization segment, in a system in which the crystalline polyester polymerization segment and the amorphous polymerization segment coexist, a method of charging a compound having a site capable of binding to both of the polyester polymerization segment and the amorphous polymerization segment may be adopted. As a result, it is possible to synthesize the hybrid resin having the structure in which the crystalline polyester polymerization segment and the amorphous polymerization segment are chemically bonded via the compound.

The third preparing method is a method of preparing a hybrid resin by performing a polymerization reaction synthesizing an amorphous polymerization segment in the presence of a crystalline polyester polymerization segment.

In this method, first, the crystalline polyester polymerization segment is synthesized by the condensation reaction of the polycarboxylic acid and the polyhydric alcohol. Next, in the presence of the crystalline polyester polymerization segment, the monomer constituting the amorphous polymerization segment is polymerized to synthesize the amorphous polymerization segment. At this time, similar to the first preparing method described above, it is preferable to incorporate the sites where these segments can react with each other in the crystalline polyester polymerization segment or the amorphous polymerization segment.

According to the above-described preparing method, it is possible to synthesize the hybrid resin having the structure (graft structure) in which the amorphous polymerization segment is chemically bonded to the crystalline polyester polymerization segment.

Among the first to third production methods described above, the first preparing method is preferable because it can easily synthesize the hybrid resin having the structure obtained by grafting the crystalline polyester polymerization segment in the amorphous polymerization segment and simplify the production process. In the first preparing method, since the amorphous polymerization segment is formed in advance and then is boned to the crystalline polyester polymerization segment, the orientation of the crystalline polyester polymerization segment tends to be uniform. Therefore, it is preferable from the viewpoint of reliably synthesizing the hybrid resin suitable for the toner.

The toner of the present embodiment preferably further includes wax. As the wax (release agent), the known waxes can be used. The wax may be one type or more. Examples of the waxes include polyolefin waxes such as polyethylene wax and polypropylene wax, branched chain hydrocarbon waxes such as microcrystalline wax; long chain hydrocarbon-based waxes such as paraffin wax and sazol wax; dialkyl ketone-based waxes such as distearyl ketone, ester-based waxes such as carnauba wax, montan wax, behenyl behenate, trimethylol propane tribehenate, pentaerythritol tetrabehenate, pentaerythritol diacetate dibehenate, glycerin tribehenate, 1,18-octadecanediol distearate, tristearyl trimellitate, and distearyl maleate, amide-based waxes such as ethylenediamine behenylamide and trimellitic acid tristearylamide, and the like. The wax is easily compatibilized with the vinyl resin. Therefore, due to the plastic effect of the wax, the sharp melting property of the toner can be enhanced and the sufficient low temperature fixability can be obtained. From the viewpoint of obtaining the sufficient low temperature fixability, the wax is preferably an ester-based wax (ester-based compound), and from the viewpoint of the compatibility of the heat resistance and the low temperature fixability, the wax is more preferably a straight chain ester-based wax (straight chain ester-based compound).

A melting point (Tmr) of the wax is preferably 60° C. or more, more preferably 65° C. or more, and still more preferably 70° C. or more from the viewpoint of reliably achieving the sufficiently high temperature storability, the low temperature fixability, and the releasability and from the viewpoint of controlling the storage elastic modulus of the toner to the predetermined range and stably obtaining the image with low gloss and the image with high gloss only by changing the fixing temperature. In addition, the melting point (Tmr) of the wax is preferably 90° C. or less, more preferably 85° C. or less, and still more preferably 80° C. or less from the viewpoint of obtaining the sufficient low temperature fixability of the toner. In particular, the melting point of the wax is particularly preferably in the range of 70° C. or more and 80° C. or less. The melting point (Tmr) of the wax can be measured in the same manner as a melting point (Tmc) of the crystalline resin. In addition, the content of the wax in the toner is preferably 1 wt % or more and 30 wt % or less, more preferably 5 wt % or more and 20 wt % or less, and still more preferably 8 wt % or more and 15 wt % or less from the viewpoint of reliably achieving the sufficiently high temperature storability, the low temperature fixability, and the releasability.

From the viewpoint of achieving the good relationship between the exothermic peak temperature of the black toner and the exothermic peak temperature of the chromatic color toner, the content of the wax in the black toner is preferably 5 to 20 mass % smaller than the wax content of the chromatic color toner.

The toner may further contain components other than the above-described binder resin and wax, within the range of achieving the effect of the present embodiment. For example, examples of other components include a colorant and a charge control agent.

The colorant may be one type or more. Examples of the typical colorants include colorants for each of magenta, yellow, cyan and black colors.

As the magenta colorant for the magenta toner, C.I. solvent red 1, C.I. solvent red 49, C.I. solvent red 52, C.I. solvent red 58, C.I. solvent red 63, C.I. solvent red 111, C.I. solvent red 122, and the like as a dye and C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 60, C.I. pigment red 63, C.I. pigment red 64, C.I. pigment red 68, C.I. pigment red 81, C.I. pigment red 83, C.I. pigment red 87, C.I. pigment red 88, C.I. pigment red 89, C.I. pigment red 90, C.I. pigment red 112, C.I. pigment red 114, C.I. pigment red 122, C.I. pigment red 123, C.I. pigment red 139, C.I. pigment red 144, C.I. pigment red 149, C.I. pigment red 150, C.I. pigment red 163, C.I. pigment red 166, C.I. pigment red 170, C.I. pigment red 177, C.I. pigment red 178, C.I. pigment red 184, C.I. pigment red 202, C.I. pigment red 206, C.I. pigment red 207, C.I. pigment red 209, C.I. pigment red 222, C.I. pigment red 238, C.I. pigment red 269, and the like as a pigment can be used, and mixtures thereof can also be used.

As the yellow colorant for the yellow toner, C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. solvent yellow 162, and the like as a dye and C.I. pigment orange 31, C.I. pigment orange 43, C.I. pigment yellow 12, C.I. pigment yellow 14, C.I. pigment yellow 15, C.I. pigment yellow 17, C.I. pigment yellow 74, C.I. pigment yellow 83, C.I. pigment yellow 93, C.I. pigment yellow 94, C.I. pigment yellow 138, C.I. pigment yellow 155, C.I. pigment yellow 162, C.I. pigment yellow 180, C.I. pigment yellow 185, and the like as a pigment can be used, and mixtures thereof can be used.

As the cyan colorant for the cyan toner, C.I. solvent blue 25, C.I. solvent blue 36, C.I. solvent blue 60, C.I. solvent blue 70, C.I. solvent blue 93, C.I. solvent blue 95 and the like as a dye and C.I. pigment blue 1, C.I. pigment blue 2, C.I. pigment blue 3, C.I. pigment blue 7, C.I. pigment blue 15, C.I. pigment blue 15:2, C.I. pigment blue 15:3, C.I. pigment blue 15:4, C.I. pigment blue 16, C.I. pigment blue 17, C.I. pigment blue 18:3, C.I. pigment blue 60, C.I. pigment blue 62, C.I. pigment blue 66, C.I. pigment blue 76, and the like as a pigment, C.I. pigment green 7, and the like can be used, and mixtures thereof can also be used.

Examples of the colorants for the black toner include carbon black and magnetic particles. Examples of the carbon blacks include channel black, furnace black, acetylene black, thermal black, and lamp black. Examples of the magnetic material of the magnetic particles include ferromagnetic metals such as iron, nickel and cobalt; alloys containing these metals, ferromagnetic metal compounds such as ferrite and magnetite; chromium dioxide; alloys no containing ferromagnetic metals but exhibiting ferromagnetism by heat treatment, and the like. Examples of the alloys exhibiting the ferromagnetism by the heat treatment include Hensler alloys such as manganese-copper-aluminum and manganese-copper-tin, and the like.

The content of the colorant in the toner base particles can be appropriately and independently determined. For example, from the viewpoint of securing color reproducibility of the image, the content of the colorant is preferably 0.5 mass % or more and 30 mass % or less, more preferably 0.5 mass % or more and 20 mass % or less, still more preferably 2 mass % or more and 20 mass % or less, and particularly preferably 2 mass % or more and 10 mass % or less. In addition, the particle size of the colorant is preferably 10 nm or more and 1,000 nm or less, more preferably 50 nm or more and 500 nm or less, and still more preferably 80 nm or more and 300 nm or less in a volume average particle size. The volume average particle size may be a catalog value, and for example, the volume average particle size (volume-based median diameter) of the colorant can be measured by "UPA-150" (manufactured by MicrotracBEL Corp.).

As the charge control agent, the known charge control agents can be used, and examples thereof include nigrosine dyes, metal salts of naphthenic acid or higher fatty acid, alkoxylated amines, quaternary ammonium salt compounds, azo metal complexes, salicylic acid metal salts, and the like. The content of the charge control agent in the toner is usually 0.1 parts by mass or more and 10 parts by mass or less and preferably 0.5 parts by mass or more and 5 parts by mass or less with respect to 100 parts by mass of the binder resin. In addition, the particle size of the charge control agent is preferably 10 nm or more and 1,000 nm or less, more preferably 50 nm or more and 500 nm or less, and still more preferably 80 nm or more and 300 nm or less in a number average primary particle size. The number average primary particle size of the particles of the charge control agent can be measured in the same manner as the external additive described later.

The external additive may be one type or more. The external additive adheres to the surface of the above-described toner base particles, thereby improving charging performance or flowability as the toner, or cleaning property. Examples of the external additives include inorganic particles, organic particles, and lubricants.

Examples of the inorganic particles include silica particles, titania particles, alumina particles, and strontium titanate particles. If necessary, the inorganic particles may be subjected to hydrophobic treatment by a known surface treating agent such as a silane coupling agent or silicone oil. In addition, the size of the inorganic particles is preferably 20 nm or more and 500 nm or less, more preferably 70 nm or more and 300 nm or less in a number average primary particle size.

As the organic particles, organic particles of a homopolymer such as styrene or methyl methacrylate or a copolymer thereof can be used. The size of the organic particles is preferably 10 nm or more and 2,000 nm or less in the number average primary particle size, and the particle shape thereof is preferably spherical, for example.

The number average primary particle size of the inorganic particles or the organic particles can be calculated using an electron micrograph. For example, the number average primary particle size can be obtained by performing image processing on an image taken with a transmission electron microscope. Alternatively, a 30,000-fold photograph of the toner sample is photographed with a scanning electron microscope, and this photographic image is captured by a scanner. The external additives (inorganic fine particles and organic fine particles) present on the toner surface of the photographic image are binarized using an image processing analyzer LUZEX (registered trademark) AP (manufactured by Nireco Corporation), a horizontal Feret diameter for 100 particles per one type of external additives is calculated, and the average value thereof may be defined as the number average primary particle size. Preferably, the external additives are measured with a laser diffraction/scattering type particle size distribution measuring device (for example, LA-750 manufactured by Horiba, Ltd., or the like), and an average particle size thereof is obtained. The average particle size thus obtained is the so-called volume average particle size. The average particle size of the inorganic particles or the organic particles is measured using the electron microscope and compared with the average particle size obtained from the measurement result by the laser diffraction/scattering type particle size distribution measuring device. Then, it is confirmed that these values coincide with each other, and it is confirmed that agglomeration of the inorganic particles or the organic particles does not occur. As a result, when it is determined that the average particle size is the size of the primary particle, the average particle size is defined as the number average primary particle size of the inorganic fine particles or organic fine particles. The number average primary particle size of the inorganic particles or the organic particles can be adjusted by, for example, classification, mixing of classified products, or the like.

The lubricant is used for the purpose of further improving the cleaning property or the transferability. Examples of the lubricants include metal salts of higher fatty acids, and more specifically, include salts of zinc, aluminum, copper, magnesium, calcium, and the like of stearic acid; salts of zinc, manganese, iron, copper, magnesium, and the like of oleic acid; salts of zinc, copper, magnesium, calcium and the like of palmitic acid; salts of zinc, calcium, and the like of linoleic acid; and salts of zinc, calcium, and the like of ricinoleic acid. The size of the lubricant is preferably 0.3 μm or more and 20 μm or less, and more preferably 0.5 μm or more and 10 μm or less in a volume-based median diameter (volume average particle size). The volume-based median diameter of the lubricant can be determined according to JIS Z8825-1 (2013).

As the measuring device, a laser diffraction/scattering type particle size distribution measuring device "LA-920" (manufactured by Horiba, Ltd.) is used. For setting of measurement conditions and analysis of measurement data, the special software "HORIBA LA-920 for Windows (registered trademark) WET (LA-920) Ver. 2.02" attached to LA-920 is used. In addition, as the measurement solvent, ion exchanged water from which impure solid matter or the like has been removed in advance is used.

The particle size of the external additive may be a catalog value or an actually measured value. The volume average particle size of the external additive can be obtained by the following method, for example. 100 primary particles of the external additive on the toner base particles were observed with the scanning electron microscope (SEM) apparatus, and the longest diameter and the shortest diameter of each external additive are measured by the image analysis of the observed primary particles. A sphere equivalent diameter can be obtained from the intermediate value of the longest diameter and the shortest diameter, which can be obtained as a diameter (D50v) of 50% at the cumulative frequency of the obtained sphere equivalent diameter. The volume average particle size of the external additive can be adjusted, for example, by pulverizing or classifying coarse products or mixing classification products.

The content of the external additive in the toner particles is preferably 0.1 parts by mass or more and 10.0 parts by mass or less with respect to 100 parts by mass of the toner particles. The external additives can be added to toner base particles using various known mixing devices such as a turbulent mixer, a Henschel mixer (registered trademark), a Nauta mixer (registered trademark), and a V type mixer.

The carrier particles include magnetic particles. Examples of magnetic substances in the magnetic particles include conventionally known materials such as metals such as iron, ferrite, and magnetite; and alloys of these metals with metals such as aluminum and lead. Among those, the magnetic particle is preferably a ferrite particle.

The carrier particle may be a resin-coated carrier particle having the magnetic particle and a resin layer coating the surface thereof, or a magnetic dispersed carrier particle in which fine particles of the magnetic material are dispersed in the resin particle. Examples of the coating resin in the resin-coated carrier particles include an olefin resin, a cyclohexyl methacrylate-methyl methacrylate copolymer, a styrene resin, a styrene acrylic resin, a silicone resin, an ester resin, a fluororesin, and the like. In addition, examples of the resins for constituting the resin particle of the magnetic substance dispersed carrier particle include an acrylic resin, a styrene acrylic resin, a polyester resin, a fluororesin, a phenolic resin, and the like.

The size of the carrier particles is preferably 15 μm or more and 100 μm or less, and more preferably 25 μm or more and 60 μm or less in the volume average particle size. The content of the carrier particles in the two-component developer is, for example, an amount so that a concentration of the toner particle is 6 to 8 mass %. In addition, the volume average particle size of the carrier particles can be measured, for example, by the same method as the particle size of the external additive.

From the viewpoint of suppressing the occurrence of fixing offset due to the flying of the toner to the heating member at the time of the fixing, the viewpoint of enhancing the transfer efficiency and the viewpoint of increasing the flowability of the toner, the average particle size of the toner base particles is preferably 3.0 μm or more and 8.0 μm or less, and more preferably 4.0 μm or more and 7.5 μm or less in the volume average particle size. The average particle size of the toner particles can be obtained by measuring the volume average particle size with "Coulter Multisizer 3" (manufactured by Beckman Coulter, Inc.), and can be controlled by the concentration of a coagulant and the added amount of solvent in the agglomeration and fusing step at the time of manufacturing the toner, the fusing time in the agglomeration and fusion step, or the composition of the binder resin.

An average circularity of the toner base particles is preferably 0.920 or more and 1.000 or less, and more preferably 0.940 or more and 0.995 or less, from the viewpoint of enhancing the transfer efficiency. The average circularity is represented by the following Equation (1). The average circularity can be measured using, for example, an average circularity measuring device "FPIA-2100" (manufactured by SYSMEX CORPORATION).

$$\text{Average circularity} = L1/L0 \quad (1)$$

In the above Formula, L0 represents a circumferential length (μm) of a particle projected image, and L1 represents a circumferential length (μm) of a circle obtained from a circle equivalent in diameter of the particle.

In addition, from the viewpoint of facilitating the compatibility between the heat resistance (for example, high temperature storability) and the low temperature fixability, it is preferable that the toner base particles have the core-shell structure.

The method of preparing a toner base particle is not limited, and examples thereof include known polymerization methods such as a suspension polymerization method, an emulsion polymerization agglomeration method, and a dispersion polymerization method. The toner base particles may be particles having the core-shell structure in which the surface of core particles made of, for example, a core resin is coated with a shell layer made of a shell resin, and may be particles of a single layer structure not having such a shell layer. In the case of the particles having the core-shell structure, the shell resin constituting the shell layer is preferably an amorphous resin, and more preferably an amorphous polyester resin. In addition, in the case of the particles having the core-shell structure, the glass transition temperature (Tg) of the shell resin constituting the shell layer is preferably in the range of 55° C. or more and 65° C. or less from the viewpoint of reliably achieving the fixability such as the low temperature fixability and the heat resistance such as the heat resistant storage property and the blocking resistance. The glass transition temperature (Tg) of the shell resin constituting the shell layer of the particles having the core-shell structure can be measured in the same manner as the Tg of the above amorphous resin.

The obtained dried toner base particles may be used as a toner as it is, but the known external additive is added to the toner base particles by a dry method to prepare toner particles, which may be used as a toner according to the embodiment of the present invention. As the mixing device of the external additives, the known various mixing devices such as the turbulent mixer, the Henschel mixer (registered trademark), the Nauta mixer (registered trademark), and the V type mixer can be used.

Hereinafter, a specific example will be described in detail with reference to the method of preparing a toner, taking the method of preparing a yellow toner as an example. In the method of preparing toners such as a magenta toner, a cyan toner, and a black toner other than the yellow toner, it is possible to suitably adopt a method of preparing a yellow toner by changing a colorant to be used. The method of preparing a toner according to the present invention is not limited to the following specific examples.

<Preparation of Aqueous Dispersion of Colorant Particles>

Sodium dodecyl sulfate was is stirred and dissolved in ion exchanged water and a yellow colorant is added to the obtained aqueous solution, such that the aqueous dispersion of the colorant particles in which the particles of the yellow colorant are dispersed is prepared.

<Preparation of Aqueous Dispersion of Wax-Containing Amorphous Vinyl Polymer>

(First Stage Polymerization)

The sodium dodecyl sulfate and the ion exchanged water are charged into a reaction vessel equipped with a stirrer, a temperature sensor, a cooling tube, and a nitrogen introducing device, and are heated while being stirred in a nitrogen gas stream, and an initiator aqueous solution prepared by dissolving the potassium persulfate in the ion exchanged water is added. Next, for example, a mixed liquid of monomers composed of styrene (St) as a styrene monomer, n-butyl acrylate (BA) as a (meth)acrylic acid ester monomer, and methacrylic acid (MAA) and the like as a compound having a carboxy group [—COOH] or a hydroxy group [—OH] is added dropwise and then is heated and stirred to perform polymerization, thereby preparing a dispersion (1) of resin particles.

(Second Stage Polymerization)

A solution prepared by dissolving sodium polyoxyethylene (2) dodecyl ether sulfate in ion exchanged water is charged into a reaction vessel equipped with a stirrer, a temperature sensor, a cooling tube, and a nitrogen introducing device. After the heating, the dispersion (1) of the resin particles and, for example, a solution containing styrene (St) as a styrene monomer, n-butyl acrylate as a (meth)acrylic acid ester monomer, and methacrylic acid (MAA) as a compound having a carboxy group [—COOH] or a hydroxy group [—OH], n-octyl-3-mercaptopropionate as a chain transfer agent, a wax (for example, behenyl behenate) and the like is added, mixed and dispersed, thereby preparing a dispersion containing emulsified particles (oil droplets).

Next, an initiator aqueous solution prepared by dissolving the potassium persulfate in the ion exchanged water is added to the dispersion, and the mixture is heated and stirred to perform polymerization, thereby preparing a dispersion (2) of resin particles.

(Third Stage Polymerization)

Ion exchanged water is added to the dispersion (2) of the resin particles and mixed well, and then an initiator aqueous solution prepared by dissolving potassium persulfate in the ion exchanged water is added. Next, for example, a mixed liquid of monomers containing styrene (St) as a styrene monomer, n-butyl acrylate (BA) as a (meth)acrylic acid ester monomer, methacrylic acid (MAA) as a compound having a carboxy group [—COOH] or a hydroxy group [—OH], n-octyl-3-mercaptopropionate as a chain transfer agent, and the like is added dropwise.

After the completion of the dropwise addition, polymerization is performed by heating and stirring, followed by cooling to prepare an aqueous dispersion of a wax-containing amorphous vinyl resin. The Tg of the outermost layer (the resin formed in the third stage polymerization) of the obtained wax-containing amorphous vinyl resin particles is preferably in the range of 55° C. or more and 65° C. or less from the viewpoint of reliably achieving the fixability such as the low temperature fixability and the heat resistance such as the heat resistant storage property and the blocking resistance. The glass transition temperature (Tg) of the resin of the outermost layer can be measured in the same manner as the Tg of the above-described amorphous resin.

<Preparation of Aqueous Dispersion of Crystalline Polyester Resin>

(Synthesis of Crystalline Polyester Resin)

As a raw material monomer and a radical polymerization initiator of an addition polymerization-based polymerization segment (here, referred to as a styrene acrylic polymerization segment which is an amorphous polymerization segment), for example, styrene, n-butyl acrylate, acrylic acid, di-t-butyl peroxide and the like are put into a dropping funnel.

In addition, as a raw material monomer of a polycondensation-based polymerization segment (herein, referred to as a crystalline polyester polymerization segment), for example, sebacic acid which is an aliphatic dicarboxylic acid and 1,12-dodecanediol which is aliphatic diol are put into a four-necked flask equipped with a nitrogen introduction tube, a dehydration tube, a stirrer, and a thermocouple, and is heated to be dissolved.

Subsequently, under the stirring, the raw material monomer and the radical polymerization initiator of the addition polymerization-based polymerization segment put into the dropping funnel is added dropwise to a material solution of the heated and dissolved polycondensation-based polymerization segment, ripens, and then an unreacted addition polymerization monomer is removed under a reduced pressure. Thereafter, an esterification catalyst is added, a temperature is raised, a reaction is performed under a normal pressure, and a reaction is further performed under the reduced pressure. After further cooling, the reaction is performed under the reduced pressure, thereby obtaining the crystalline polyester resin as the hybrid resin.

(Preparation of Aqueous Dispersion of Crystalline Polyester Resin)

The crystalline polyester resin obtained in the synthesis example is dissolved in a solvent (for example, methyl ethyl ketone) while being stirred. Next, a sodium hydroxide aqueous solution is added to this solution. Water is added dropwise and mixed to prepare an emulsified liquid while this solution is stirred. Subsequently, the solvent is distilled and removed from the emulsified liquid, thereby preparing an aqueous dispersion in which the crystalline polyester resin is dispersed.

<Preparation of Aqueous Dispersion of Amorphous Polyester Resin>

(Synthesis of Amorphous Polyester Resin)

For example, bisphenol A propylene oxide 2 mol adduct, terephthalic acid, fumaric acid, and an esterification catalyst (for example, tin octylate) are put into the reaction vessel equipped with the nitrogen introduction tube, the dehydration tube, the stirrer, and the thermocouple, is subjected to the polycondensation reaction, further reacts under the reduced pressure, and cooled.

Next, for example, a mixture containing acrylic acid as a compound having a carboxy group [—COOH] or a hydroxy group [—OH], styrene as a styrene monomer, butyl acrylate as a (meth)acrylic acid ester monomer, and, for example, di-t-butyl peroxide as a polymerization initiator is added dropwise into the reaction vessel. After the dropwise addition and then the addition polymerization reaction, the temperature is raised, and after the reaction is kept under the reduced pressure, the compound having the carboxy group [—COOH] or the hydroxy group [—OH], the styrene monomer, and the (meth)acrylic acid ester monomer are removed. In this way, the amorphous polyester resin obtained by bonding the vinyl polymerization segment and the amorphous polyester polymerization segment is synthesized.

(Preparation of Aqueous Dispersion of Amorphous Polyester Resin)

The amorphous polyester resin obtained in the synthesis example is dissolved in a solvent (for example, methyl ethyl ketone) while being stirred. Next, the sodium hydroxide aqueous solution is added to this solution. Water is added dropwise and mixed to prepare an emulsified liquid while this solution is stirred. Subsequently, the solvent is distilled and removed from the emulsified liquid, thereby preparing an aqueous dispersion in which the amorphous polyester resin is dispersed.

<Preparation of Yellow Toner>

The aqueous dispersion of the wax-containing amorphous vinyl resin and the ion exchanged water are charged into the reaction vessel equipped with the stirrer, the temperature sensor, and the cooling tube and then an aqueous sodium hydroxide solution is added to adjust pH.

Thereafter, the aqueous dispersion of the colorant particles is charged into the reaction vessel, and then an aqueous solution of magnesium chloride is added to prepare a mixed liquid. The temperature of the mixed liquid is raised, and an aqueous dispersion of the crystalline polyester resin is further added to the mixed liquid to progress agglomeration. When the agglomerated particles have reached a desired particle size, the aqueous dispersion of the amorphous polyester resin is charged and the aqueous solution prepared by dissolving the sodium chloride in the ion exchanged water is added to stop the growth of the particles. Thereafter, the mixed liquid is heated and stirred to progress the fusion of the particles. Thereafter, the cooling is performed.

Subsequently, the mixed liquid is subjected to solid-liquid separation, and the obtained solid content (toner base particles) is washed and then dried to obtain the yellow toner base particles. By adding the external additive to the obtained yellow toner base particles, the yellow toner particles are prepared.

(Method of Preparing Two-Component Developer)

A known ferrite carrier is added to the yellow toner particles in an amount of, for example, 6 mass % or more and 8 mass % or less in a toner concentration and mixed to prepare a two-component developer.

The toner is used in an image forming method according to the embodiment of the present invention in the electrophotographic scheme. Since the toner sufficiently has any of the high temperature storability, the separability, and the gloss uniformity in addition to the low temperature fixability, the toner is useful for forming high-quality images and since the toner has excellent in storage stability, the toner is useful from the viewpoint of distribution.

As is apparent from the above description, the toner is preferably a toner which has toner base particles containing a binder resin containing a crystalline resin and an amorphous resin (vinyl resin) and wax, and has a storage elastic modulus in the above-described specific range. By having such a configuration, the toner sufficiently has any of the high temperature storability, the separability, and the gloss uniformity in addition to the low temperature fixability. In addition, by combining with the fixing belt having the elastic layer using the elastic layer material having the storage elastic modulus in the above-described specific range, it is possible to stably obtain the image with low gloss and the image with high gloss only by changing the fixing temperature.

EXAMPLES

Hereinafter, the embodiment of the present invention will be described in detail with reference to Examples, but the present invention is not limited to these Examples. In the following Examples, unless otherwise specified, measurement of each operation, physical properties, or the like was carried out under conditions of room temperature (20 to 25° C.)/relative humidity (RH) of 40 to 50% RH.

[Synthesis of Amorphous Polyester Resin]

The following components were charged into a reaction vessel equipped with a stirrer, a nitrogen introduction tube, a temperature sensor, and a rectifying column in the following amounts, and a temperature of contents was raised to 190° C. over 1 hour. "Fumaric acid" and "terephthalic acid" are polycarboxylic acids. In addition, "2,2-BPPO" is "2,2-bis(4-hydroxyphenyl) propane propylene oxide 2 mol adduct", and "2,2-BPEO" is "2,2-bis(4-hydroxyphenyl) propane ethylene oxide 2 mol adduct", which correspond to polyhydric alcohols:

Fumaric acid 1.8 parts by mass

Terephthalic acid 29.2 parts by mass 2,2-BPPO 58.2 parts by mass 2,2-BPEO 6.7 parts by mass.

After it was confirmed that the contents were homogeneously stirred, 0.006 mass % of dibutyltin oxide with respect to the total amount of polycarboxylic acid as a catalyst was charged into the above reaction vessel. The temperature of the contents was raised from 190° C. to 240° C. over 6 hours while water to be produced was distilled off, and 2.4 parts by mass of trimellitic acid was further added when the temperature of the contents reached 240° C. Thereafter, a dehydrating condensation reaction was continued at 240° C. until an acid value of the product reached 21 mg KOH/g, thereby obtaining an amorphous polyester resin.

The amorphous polyester resin thus obtained had a number average molecular weight (Mn) of 3,600 and a glass transition temperature (Tg) of 62° C.

[Preparation of Aqueous Dispersion A of Amorphous Polyester Resin Particles]

240 parts by mass of methyl ethyl ketone and 60 parts by mass of isopropyl alcohol (IPA) were added to the reaction vessel having an anchor blade imparting stirring power, and nitrogen was sent to substitute air in a system. Next, 300 parts by mass of the amorphous polyester resin was slowly added to the mixed solvent while the mixed solvent was heated to 60° C. by an oil bath, and was dissolved while being stirred. Next, 20 parts by mass of 10% ammonia water was added to the obtained solution, and 1,500 parts by mass of deionized water was added using a metering pump while the solution was stirred. It was confirmed that the liquid in the reaction vessel had a milky white color and the viscosity of the liquid decreased, and the emulsification was progressed.

Thereafter, an emulsified liquid was pumped up by a differential pressure based on a centrifugal force, and transferred to a separable flask having a stirring blade, a reflux device, and a vacuum pump as a decompressor, which form a wetted wall on the wall in the reaction tank. A pressure in a reaction tank was reduced under the condition that a wall temperature in the reaction tank is 58° C., the solvent and the dispersion medium were distilled off while the stirring of the emulsified liquid was continued, and the time when the dispersion in the emulsified liquid reached 1,000 parts by mass was defined as an end point of a vacuum concentration. An internal pressure of the reaction tank was set to atmospheric pressure and the reaction tank was cooled to room temperature while being stirred to obtain the aqueous dispersion A of the amorphous polyester resin particle having a solid content of 30 mass %. A volume-based median diameter (D50v) of the amorphous polyester resin particles in the aqueous dispersion A was 162 nm.

[Synthesis of Crystalline Polyester Resin 1]

A raw material monomer of the following addition polymerization-based polymerization segment (styrene acrylic polymerization segment: StAc) containing a bi-reactive monomer and a radical polymerization initiator (di-t-butyl peroxide) were put into a dropping funnel in the following amounts to obtain a monomer solution 1A:

Styrene 43.5 parts by mass n-Butyl acrylate 16 parts by mass

Acrylic acid 3.5 parts by mass di-t-Butyl peroxide 8 parts by mass.

In addition, the raw material monomer of the following polycondensation-based polymerization segment (crystalline polyester polymerization segment: CPEs) was charged into a four-necked flask equipped with the nitrogen introduction tube, the dehydration tube, the stirrer, and the thermocouple in the following amounts, and heated at 170° C. to be dissolved:

Tetradecanedioic acid 358 parts by mass 1,12-dodecanediol 145 parts by mass.

Subsequently, the monomer solution 1A was added dropwise to the monomer solution in the four-necked flask under the stirring over 90 minutes, followed by the ripening for 60 minutes, and then the unreacted addition polymerization monomer was removed from the inside of the four-necked flask under the reduced pressure (8 kPa). The amount of monomer removed at this time was very small compared to the amount of the monomer liquid 1A.

Thereafter, 0.8 parts by mass of $Ti(OBu)_4$ as an esterification catalyst was charged into the mixed liquid in the four-necked flask, the temperature of the mixed liquid was raised to 235° C., and the reaction was performed for 5 hours under a normal pressure (101.3 kPa) and for 1 hour under the reduced pressure (8 kPa). The obtained mixed liquid was cooled to 200° C. and then further reacted under the reduced pressure (20 kPa) for 1 hour to obtain the crystalline polyester resin 1.

The crystalline polyester resin 1 was the hybrid resin which contains 10 mass % of a polymerization segment (StAc) other than the CPEs segment with respect to the total amount thereof and has the form in which the CPEs segment was grafted to the StAc segment. The obtained crystalline polyester resin 1 had a number average molecular weight (Mn) of 9,500 and a melting point (Tmc) of 72° C.

[Preparation of Aqueous Dispersion 1C of Particles of Crystalline Polyester Resin 1] 82 parts by mass of the crystalline polyester resin 1 was stirred in 82 parts by mass of methyl ethyl ketone at 70° C. for 30 minutes and dissolved. Next, 2.5 parts by mass of 25 mass % sodium hydroxide aqueous solution (corresponding to a neutralization degree of 50%) was added to this solution. The obtained solution was put into the reaction vessel having the stirrer and stirred, and 236 parts by mass of water heated to 70° C. was added dropwise for 70 minutes and mixed. The solution became turbid during the dropwise addition and the total amount of water was added dropwise to obtain a uniform emulsion. A result of measuring the volume average particle size of the oil droplets of this emulsion with a laser diffraction type particle size distribution measuring instrument "LA-750 (manufactured by Horiba, Ltd.)" was 123 nm.

Subsequently, the emulsion was stirred for 3 hours under a reduced pressure of 15 kPa (150 mbar) while being kept at 70° C. by using the diaphragm type vacuum pump "V-700" (manufactured by BUCHI) to distill off methyl ethyl ketone. As a result, an aqueous dispersion 1C (solid content: 25 mass %) in which particles of crystalline polyester resin 1 were dispersed was prepared. As a result of measurement by the laser diffraction type particle size distribution measuring instrument, the volume average particle size of particles of the crystalline polyester resin 1 in the aqueous dispersion 1C was 75 nm. The composition of the aqueous dispersion 1C of particles of the obtained crystalline polyester resin 1 is shown in the following Table 1.

TABLE 1

| | Composition (parts by mass) | |
|---|---|---|
| Aqueous dispersion No. | CPEs segment | StAc segment |
| 1C | 90 | 10 |

[Preparation of Aqueous Dispersion Liquid 1A of Particles of Amorphous Resin 1]

(First Stage Polymerization)

8 parts by mass of sodium dodecyl sulfate and 3 L of ion exchanged water were charged into 5 L of reaction vessel equipped with a stirrer, a temperature sensor, a cooling tube, and a nitrogen introducing device, and an temperature of the solution was raised to 80° C. while stirring at a stirring speed of 230 rpm under a nitrogen stream. After the temperature increased, the initiator aqueous solution prepared by dissolving 10 parts by mass of potassium persulfate in 200 parts by mass of ion exchanged water was added to the obtained aqueous solution, and the temperature of the solution was raised to 80° C. again.

Subsequently, a monomer mixed liquid containing the following components in the following amounts was added dropwise to the obtained mixed liquid over 1 hour and then was heated and stirred at 80° C. for 2 hours to perform the polymerization, thereby preparing a resin particle dispersion x1:

Styrene 480 parts by mass
n-Butyl acrylate 250 parts by mass
Methacrylic acid 68.0 parts by mass.

(Second Stage Polymerization)

An aqueous solution prepared by dissolving 7 parts by mass of sodium polyoxyethylene (2) dodecyl ether sulfate in 3 L of ion exchanged water was charged in a 5 L of reaction vessel equipped with a stirrer, a temperature sensor, a cooling tube, and a nitrogen introducing device and was heated to 80° C. Thereafter, a dispersion x1 of 260 parts by mass of resin particles and a raw material solution containing the following components in the following amounts and dissolved at 80° C. were added to the aqueous solution, and were mixed and dispersed for 1 hour by a mechanical type dispersing machine "CLEARMIX" ("CLEARMIX" as a registered trademark manufactured by M Technique Co., Ltd.) having a circulation route to prepare a dispersion containing emulsified particles (oil droplets). "Behenyl behenate" corresponds to the wax and a melting point (Tmr) thereof was 73° C.:

Styrene 284 parts by mass
2-Ethylhexyl acrylate 87 parts by mass
Methacrylic acid 28 parts by mass
n-Octyl-3-mercaptopropionate 6.4 parts by mass
Behenyl behenate 350 parts by mass.

Subsequently, an initiator aqueous solution prepared by dissolving 5.6 parts by mass of potassium persulfate in 200 mL of ion exchanged water was added to the above dispersion, and the obtained mixed liquid was heated and stirred at 84° C. over 1 hour to perform the polymerization, thereby preparing a resin particle dispersion x2.

(Third Stage Polymerization)

In addition, 400 mL of ion exchanged water was added to the resin particle dispersion x2 and mixed well, and then the initiator aqueous solution prepared by dissolving 6.6 parts by mass of potassium persulfate in 400 mL of ion exchanged water was further added. Then, the obtained dispersion rose to a temperature of 82° C., and the monomer mixed liquid containing the following components in the following amounts was added dropwise over 1 hour:

Styrene 430 parts by mass
n-Butyl acrylate 155 parts by mass
Methacrylic acid 51 parts by mass
n-Octyl-3-mercaptopropionate 8 parts by mass.

After the completion of the added dropwise, the polymerization was performed by heating and stirring for 2 hours, followed by the cooling to 28° C. to obtain the aqueous dispersion 1A (solid content: 24 mass %) of particles of the amorphous resin 1 made of a vinyl resin. The volume-based median diameter (D50v) of particles of the amorphous resin 1 in the aqueous dispersion 1A was 220 nm, the glass transition temperature (Tg) of the amorphous resin 1 was 55° C., and the weight average molecular weight (Mw) thereof was 32,000.

[Preparation of Aqueous Dispersion Liquids 2A to 7A of Particles of Amorphous Resins 2 to 7]

Except that the raw materials in the second stage polymerization and the amounts thereof were changed as shown in the following Table 2, each of the aqueous dispersions 2A to 7A in which the particles of the amorphous resins 2 to 7 were dispersed was obtained in the same manner as in the preparation of the aqueous dispersion 1A.

The composition of raw materials of amorphous resins 1 to 7 is shown in the following Table 2. In Table 2, "St" represents styrene, "MAA" represents methacrylic acid, "KPS" represents potassium persulfate, "2EHA" represents 2-ethylhexyl acrylate, "NOM" represents n-octyl-3-mercaptopropionate, "BB" represents behenyl behenate (melting point (Tmr): 73° C.), "MC" represents microcrystalline wax (melting point (Tmr): 89° C.), and "SS" represents stearyl stearate (melting point (Tmr): 67° C.). In addition, numerical values in the following Table 2 represent values in parts by mass, excluding the melting point (Tmr) of the wax.

TABLE 2

| Amorphous resin | Aqueous dispersion | First Stage Polymerization | | | | Dispersion | Second Stage Polymerization | | | | Wax | | | Third Stage Polymerization | | | | |
|---|---|---|---|---|---|---|---|---|---|---|---|---|---|---|---|---|---|---|
| No. | No. | St | BA | MAA | KPS | x1 | St | 2EHA | MAA | NOM | Type | Melting point (° C.) | Amount | St | BA | MAA | NOM | KSP |
| 1 | 1A | 480 | 250 | 68 | 10 | 260 | 87 | 28 | 6.4 | 5.6 | BB | 73 | 230 | 355 | 151 | 44 | 10.2 | 6.6 |
| 2 | 2A | | | | | | | | | | BB | 73 | 130 | 355 | 151 | | | |
| 3 | 3A | | | | | | | | | | BB | 73 | 230 | 320 | 181 | | | |
| 4 | 4A | | | | | | | | | | BB | 73 | 230 | 391 | 117 | | | |
| 5 | 5A | | | | | | | | | | SS | 67 | 230 | 355 | 151 | | | |
| 6 | 6A | | | | | | | | | | MC | 89 | 230 | 355 | 151 | | | |
| 7 | 7A | | | | | | | | | | MC | 89 | 430 | 355 | 151 | | | |

[Preparation of Yellow Colorant Particle Dispersion Y]

95.0 parts by mass of sodium dodecyl sulfate was added to 1,600.0 parts by mass of ion exchanged water. 250.0 parts by mass of yellow colorant (C.I. pigment yellow 74) was gradually added while the solution is stirred. Subsequently, the dispersion treatment was carried out using the stirrer "CLEARMIX" (manufactured by M Technique Co., Ltd.) to prepare the yellow colorant particle dispersion Y in which the yellow colorant particles were dispersed.

The volume average particle size (volume-based median diameter) of the yellow colorant particles contained in the obtained yellow colorant particle dispersion Y was 120 nm.

[Preparation of Magenta Colorant Particle Dispersion M]

95.0 parts by mass of sodium dodecyl sulfate was added to 1,600.0 parts by mass of ion exchanged water. 250.0 parts by mass of magenta colorant (C.I. pigment red 122) was gradually added while the solution is stirred. Subsequently, the dispersion treatment was carried out using the stirrer "CLEARMIX" (manufactured by M Technique Co., Ltd.) to prepare the magenta colorant particle dispersion M in which the magenta colorant particles were dispersed.

The volume average particle size (volume-based median diameter) of the magenta colorant particles contained in the obtained magenta colorant particle dispersion M was 115 nm.

[Preparation of Cyan Colorant Particle Dispersion C]

90.0 parts by mass of sodium dodecyl sulfate was added to 1,600.0 parts by mass of ion exchanged water. 420.0 parts by mass of cyan colorant (C.I. pigment blue 15:3) was gradually added while the solution is stirred. Subsequently, the dispersion treatment was carried out using the stirrer "CLEARMIX" (manufactured by M Technique Co., Ltd.) to prepare the cyan colorant particle dispersion C in which the cyan colorant particles were dispersed.

The average particle size (volume-based median diameter) of the cyan colorant particles contained in the obtained cyan colorant particle dispersion C was 110 nm.

[Preparation of Toner 1]

While 3,041 parts by mass of aqueous dispersion 1A, 350 parts by mass of aqueous dispersion Y, and 300 parts by mass of ion exchanged water were charged into the reaction vessel equipped with the stirrer, the temperature sensor, the cooling tube, and the nitrogen introducing device and stirred, 5 mol/liter of aqueous sodium hydroxide solution was added to adjust pH of the dispersion to 10.5 (20° C.). The amount of the aqueous dispersion 1A corresponds to 730 parts by mass in the solid content. The amount of the aqueous dispersion Y corresponds to 70 parts by mass in the solid content.

Next, an aqueous solution in which 160 parts by mass of magnesium chloride is dispersed in 160 parts by mass of ion exchanged water was added to the dispersion at a speed of 10 parts by mass/min. After the dispersion is leaved for 5 minutes, the temperature rising was started, the dispersion was heated to 80° C. over 60 minutes, and the particles in the dispersion were agglomerated at this temperature.

When the average particle size of the agglomerated particles in the dispersion became 2.4 μm, 333 parts by mass of the aqueous dispersion 1C was added to the dispersion over 10 minutes and rose to the temperature of 85° C., and the agglomeration reaction was progressed. The amount of the aqueous dispersion 1C corresponds to 100 parts by mass in the solid content.

Sampling was periodically performed in the agglomeration reaction, and the volume-based median diameter (D50v) of agglomerated particles was measured using the particle size distribution measuring apparatus "Coulter Multisizer 3" (manufactured by Beckman Coulter, Inc.). The stirring was continued until the D50v of the agglomerated particles became 5.9 μm while the stirring speed was decreased as necessary, and the agglomeration reaction was performed.

When the D50v of the agglomerated particles reached 5.9 nm, the stirring speed was increased and 333 parts by mass of aqueous dispersion A was added to the dispersion over 40 minutes. The amount of the aqueous dispersion A corresponds to 100 parts by mass in the solid content.

Thereafter, after it is confirmed that the dispersion is sampled and the supernatant is transparent by centrifugal separation, the aqueous solution prepared by dispersing 300 parts by mass of sodium chloride in 1,200 parts by mass of ion exchanged water was added to the dispersion, and the dispersion was continuously stirred at the temperature of 80° C. The average circularity of the particles in the dispersion was measured by a flow type particle image analyzer "FPIA-2100" (manufactured by SYSMEX CORPORATION), and at the time when the average circularity reached 0.961, the dispersion liquid was cooled to 30° C. at a speed of 6° C./min to stop the agglomeration reaction, thereby obtaining the dispersion of the colored particle 1. The volume average particle size (D50v) of the colored particle 1 after the cooling was 6.1 nm, and the average circularity thereof was 0.961.

Using a basket type centrifugal separator "MARK III Type No. 60×40" (manufactured by Matsumoto Machine Manufacturing Co., Ltd.), the dispersion of the colored particle 1 was subjected to the solid-liquid separation to obtain a wet cake. The washing and the solid-liquid separation of the wet cake were repeated by the basket type centrifugal separator until the electric conductivity of the filtrate reached 15 μS/cm. The washed wet cake was supplied to "Flash Jet Dryer" (manufactured by Seishin Enterprise Co., Ltd.) little by little and an air flow was blown into the wet cake at a temperature of 40° C. and a humidity (RH) of 20% RH, so the wet cake was dried until a water content became about 2.0 mass %, and then cooled to 24° C. Thereafter, the dried and cooled powder cake was transferred to "oscillating fluidized bed apparatus" (manufactured by Chuo Kakohki Co., Ltd.), and the powder cake was dried at 40° C. for 2 hours. By doing so, the toner base particle 1 having a water content of 0.5% or less was obtained.

The toner base particles 1 were treated with the external additive treatment to obtain the toner particles 1. In the external additive treatment, hydrophobic silica (number average primary particle size=12 nm, hydrophobicity=68) is added to the toner base particle 1 in an amount of 1 mass %, and hydrophobic titanium oxide (number average primary particle size=20 nm, hydrophobicity=63) was added thereto in an amount of 1.2 mass %. The mixing was performed for 20 minutes at a peripheral speed of a rotor blade of 24 mm/sec with "Henschel Mixer (registered trademark)" (manufactured by Nippon Coke & Engineering Co., Ltd.), and then coarse particles were removed using a 400 mesh sieve.

Ferrite carrier particles coated with an acrylic resin and having a volume average particle size of 32 μm were added to the toner particle 1 so that the toner particle concentration became 6 mass %, and mixed, thereby obtaining a yellow developer 1 as a two-component developer for yellow.

In addition, the magenta developer 1 and the cyan developer 1 which are the two-component developer for magenta and cyan ware each prepared in the same manner as in the preparation of the yellow developer 1 except that aqueous dispersion Y of the colorant particles is changed to the aqueous dispersions M and C.

[Preparation of Developers 2 to 8]

Each color developer 2 to 8 of YMC which is the two-component developer was prepared in the same manner as the preparation of each color developer 1 of YMC which is the two-component developer, except that the type and the amount of the aqueous dispersion was changed as shown in Table 3.

The resin compositions of the respective toners 1 to 8 for yellow, magenta, and cyan are shown in Table 3 (the resin composition is common to each color toner of YMC). The content in Table 3 represents the content in the toner base particles. In addition, in Table 3, "APES" represents the aqueous dispersion A of the amorphous polyester resin particles.

TABLE 3

| Toner No. | Amorphous resin Aqueous dispersion No. | Amorphous resin Content (mass %) | APEs Content (mass %) | CPEs Aqueous dispersion No. | CPEs Content (mass %) | Colorant Type | Colorant Content (mass %) |
|---|---|---|---|---|---|---|---|
| 1 | 1A | 73 | 10 | 1C | 10 | Y, M, C | 7 |
| 2 | 2A | 73 | 10 | 1C | 10 | Y, M, C | 7 |
| 3 | 3A | 73 | 10 | 1C | 10 | Y, M, C | 7 |
| 4 | 4A | 73 | 10 | 1C | 10 | Y, M, C | 7 |
| 5 | 5A | 73 | 10 | 1C | 10 | Y, M, C | 7 |
| 6 | 6A | 73 | 10 | 1C | 10 | Y, M, C | 7 |
| 7 | 2A | 81 | 11 | — | 0 | Y, M, C | 8 |
| 8 | 7A | 81 | 11 | — | 0 | Y, M, C | 8 |

[Measurement of Storage Elastic Modulus of Toner]

The storage elastic modulus at 70° C. and 90° C. was measured using each of the toner particles 1 to 8 as a measurement sample.

0.2 g of each of the toner particles 1 to 8 was weighed, and a pressure of 25 MPa was applied by a compression molding machine to perform pressure molding, thereby preparing a columnar pellet having a diameter of 10 mm. The measurement was performed under the condition of a frequency of 1 Hz using a rheometer "ARES G2" (manufactured by TA Instruments) and using parallel plates having a diameter of 8 mm in upper and lower sets. The sample set was performed at 100° C., and a gap between the plates was once set to 1.6 mm, and then the sample protruding between the plates was scraped off. Thereafter, the gap between the plates was set to 1.4 mm, and the pellet was cooled down to 25° C. while being applied with an axial force and was left for 10 minutes. Thereafter, the axial force was stopped and a temperature rising measurement of the storage elastic modulus from 25° C. to 100° C. was performed. A ramp rate was set to 3° C./min, and a curve of temperature dispersion was obtained. Based on the curve of the temperature dispersion, the storage elastic modulus when the measurement temperature is 70° C. and 90° C. was measured (calculated). The obtained results are shown in the following Table 5.

Detailed measurement conditions are shown below:

Frequency: 1 Hz
Ramp rate: 3° C./min
Axial force: 0 g
Sensitivity: 10 g
Initial strain: 0.01%
Strain adjust: 30.0%
Minimum strain: 0.01%
Maximum strain: 10.0%
Minimum torque: 1 g·cm
Maximum torque: 80 g·cm
Sampling interval: 1.0° C./pt.

The storage elastic modulus of the toner particles 1 to 8 at 70° C. and 90° C., the content (mass %) of the wax, the presence or absence of the crystalline polyester resin, the Tg (° C.) of the shell, and the melting point (° C.) of the wax are shown in the following Table 4.

[Production of Fixing Belt a]

A cylindrical core metal made of stainless steel having an outer diameter of 99 mm comes into close contact with the inside of a belt base made of a thermosetting polyimide resin having an inner diameter of 99 mm, a length of 360 mm, and a thickness of 70 μm. Next, an outer side of the belt base is coated with a cylindrical metal mold which holds a PFA tube having a thickness of 30 μm on an inner peripheral surface, so that the core metal and the cylindrical metal mold were held coaxially and a cavity was formed between the core metal and the cylindrical metal mold. Subsequently, a silicone rubber material A was injected into the cavity and heated and cured to produce an elastic layer of the silicone rubber A (elastic layer material) having a thickness of 250 μm. In this way, a fixing belt a was produced by stacking the base layer, the elastic layer of the silicone rubber A, and the surface layer (release layer) made of PFA in this order.

The silicone rubber material A had a composition obtained by mixing 100 parts by mass of a dimethylpolysiloxane having a vinyl group in a side chain thereof, 3 parts by mass of a hydroxyl group-containing dimethylpolysiloxane as a crosslinking agent, and 20 parts by mass of silica, and the thermal conductivity thereof was 0.6 W/m·K.

The hardness of the silicone rubber A was measured by a durometer A using a measurement rubber sheet having a thickness of 2.0 mm according to JIS K6253-3:2012.

[Production of Fixing Belts b to h]

Except that the type of dimethylpolysiloxane having the vinyl group in the side chain thereof, plural types of mixing ratios, the added amount of additives, and the like were adjusted, a fixing belt b having an elastic layer made of silicone rubber B, a fixing belt g having an elastic layer made of silicone rubber C, and a fixing belt h having an elastic layer made of silicone rubber D were each produced in the same manner as the silicone rubber A.

The fixing belt c was produced in the same manner as the fixing belt b except that the thickness of the surface layer of the fixing belt b was changed from 30 μm to 3 μm. The fixing belt d was produced in the same manner as the fixing belt b except that the thickness of the surface layer of the fixing belt b was changed from 30 μm to 60 μm. The fixing belt e was produced in the same manner as the fixing belt b except that the thickness of the elastic layer of the fixing belt b was changed from 250 μm to 100 μm. The fixing belt f was produced in the same manner as the fixing belt b except that the thickness of the elastic layer of the fixing belt b was changed from 250 μm to 550 μm.

Among those, in connection with the silicone rubber B, a plurality of samples of silicone rubber in which the amount of crosslinking agent in the silicone rubber material A is gradually increased were produced and the storage elastic modulus of each sample was measured, so the sample in which the elastic layer having the storage elastic modulus in a target range is obtained was selected as the silicone rubber B. Here, the target range of the storage elastic modulus of the elastic layer made of the silicone rubber B was higher than the storage elastic modulus of the elastic layer made of the silicone rubber A, and was the upper limit specified in the present invention or was in a range of $2.2\times10^6$ Pa or more and $2.5\times10^6$ Pa or less approximating the upper limit. In addition, in connection with the silicone rubber C, a plurality of samples of silicone rubber in which the type of dimethylpolysiloxane as an elastic resin material in the silicone rubber material A is changed (more specifically, the number of vinyl groups in the side chain is gradually increased) were produced and the storage elastic modulus of each sample was measured, so the sample in which the elastic layer having the storage elastic modulus in a target range is obtained was selected as the silicone rubber C. Here, the target range of the storage elastic modulus of the elastic layer made of the silicone rubber C was much higher than the storage elastic modulus of the elastic layer made of the silicone rubber A, and was in a range of $4\times10^6$ Pa or more and $5\times10^6$ Pa or less which exceeds $2.5\times10^6$ Pa as the upper limit specified in the present invention. In addition, in connection with the silicone rubber D, a plurality of samples of silicone rubber in which both the crosslinking agent in the silicone rubber material A and the type of dimethylpolysiloxane of the elastic resin material are changed (more specifically, the crosslinking agent having lower reactivity is selected and the number of vinyl groups in the side chain is gradually decreased) was produced, and the storage elastic modulus of each sample was measured, so the sample in which the elastic layer having the storage elastic modulus in the target range is obtained was selected as the silicone rubber D. Here, the target range of the storage elastic modulus of the elastic layer made of the silicone rubber D was smaller than the storage elastic modulus of the elastic layer made of the silicone rubber A, and was in a range of $0.7\times10^6$ ($7\times10^5$) Pa or more and $0.9\times10^6$ ($9\times10^5$) Pa or less which is less than $1.0\times10^6$ Pa as the lower limit specified in the present invention.

[Measurement of Storage Elastic Modulus of Elastic Layer Material]

The storage elastic modulus at 200° C. of each of the rubber sheets A to D for evaluation having a thickness of 2 mm as a measurement sample was measured, in which each of the evaluation rubber sheets A to D was prepared by heating and curing in the same manner as the silicone rubbers A to D of the elastic layer material.

Figure 6:
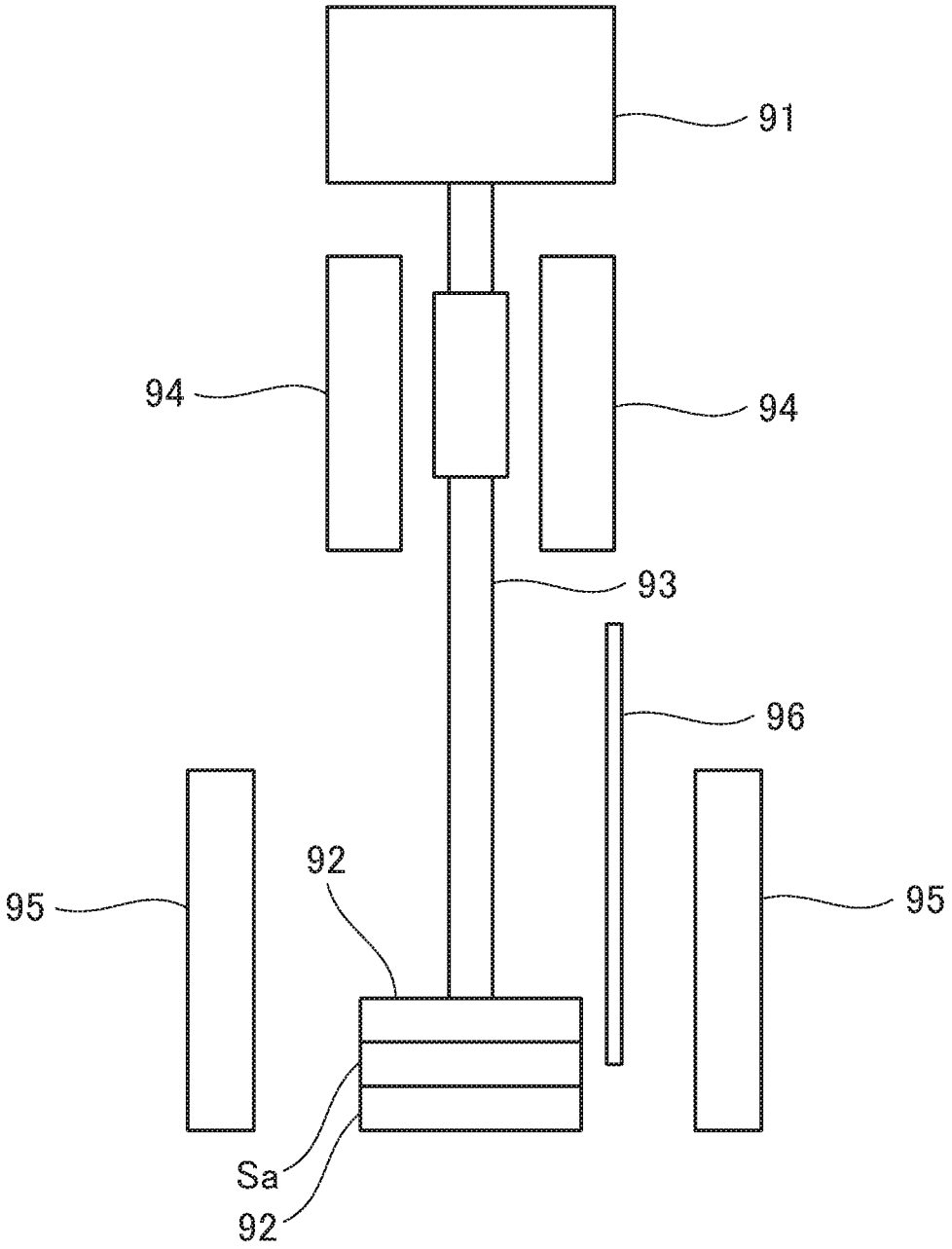
FIG. 6 is a diagram schematically showing a dynamic viscoelasticity measuring device used in Examples, in which reference numeral 91 denotes a load generating section, reference numeral 92 denotes a plate holder, reference numeral 93 denotes a probe, reference numeral 94 denotes a displacement detecting section, reference numeral 95 denotes a heater, reference numeral 96 denotes a thermometer, and reference sign Sa denotes a specimen.

The storage elastic modulus was measured by the dynamic viscoelasticity measuring device as shown in FIG. 6 using these rubber sheets for evaluation A to D. As shown in FIG. 6, the dynamic viscoelasticity measuring device includes a load generating section 91, two plate holders 92 which hold both surfaces (both ends) of a specimen (rubber sheet) Sa, a probe 93 connecting between the load generating section 91 and the plate holder 92, a displacement detecting section 94 which detects a displacement amount of the probe 93, a heater 95 which adjusts an ambient temperature of the specimen Sa held by the two plate holders 92, and a thermometer 96 which detects the ambient temperature.

First, each disc-shaped specimen (rubber sheets A to D for evaluation) Sa having a thickness of 2 mm and having the same size as the diameter of the plate holder 92 are sandwiched between two circular plate holders 92 each having a diameter of 15 mm. Thereafter, the ambient temperature which is heated by the heater 95 which adjusts the ambient temperature of each specimen Sa and detected by the thermometer 96 was increased from 50° C. to 200° C. The storage elastic modulus was obtained from the results obtained by generating a force of a sinusoidal waveform having an amplitude of 0.1% of the thickness of the specimen Sa in a vertical direction (thickness direction of the specimen Sa) by the load generating section 91 at the frequency 1 Hz, and detecting the displacement amount of the probe 93 at the time point by the displacement detecting section 94.

TABLE 4

| Fixing belt type | Silicone rubber material type | Storage elastic modulus of elastic layer material at 200° C. (Pa) | Thickness of surface layer (μm) | Thickness of elastic layer (μm) |
|---|---|---|---|---|
| a | A | 1.4 × 106 | 30 | 250 |
| b | B | 2.3 × 106 | 30 | 250 |
| c | B | 2.3 × 106 | 3 | 250 |
| d | B | 2.3 × 106 | 60 | 250 |
| e | B | 2.3 × 106 | 30 | 100 |
| f | B | 2.3 × 106 | 30 | 550 |
| g | C | 4.5 × 106 | 30 | 250 |
| h | D | 8.5 × 106 | 30 | 250 |

Example 1

A fixing belt a was installed as a fixing belt of an electro-photographic image forming apparatus as shown in FIGS. 1 and 2. In rollers constituting a fixing nip portion, a diameter of a roller (roller biased to a pressure roller) on a side pivotally supporting the fixing belt a was 60 mm. The fixing belt a was pivotally supported by two or more rollers so as to have a tension of 43 N, and a separation angle at the fixing section was set to 73° at a printing speed of 60 sheets/min on A4 plain paper. In addition, as the developer, a developer 1 of each color of YMC shown in the following Table 5 was used and the developing section was filled with the developer to manufacture the image forming apparatus.

Examples 2 to 11 and Comparative Examples 1 to 4

The image forming apparatuses of Examples 2 to 11 and Comparative Examples 1 to 4 were manufactured in the same manner as in Example 1 except that fixing belts a to h shown in the following Table 5 and developers 1 to 8 of each color were appropriately combined.

[Gloss Evaluation]

As the recording material, a 128 g/m$^2$ of A3 size of POD gloss coat made by Oji Paper Co., Ltd. was used. Feeding a recording material to a sheet feeding tray unit and using the image forming apparatuses manufactured in Examples 1 to 11 and Comparative Examples 1 to 4, an image having red of two layers of magenta and yellow, blue of two layers of magenta and cyan, and green of two layers of cyan and yellow each of which has an attached amount of 7.0 g/m$^2$ was formed. 60° glosses of red, blue, and green were measured using a gloss meter and averaged. A surface temperature (fixing temperature) of the fixing belt was 175° C. and 185° C. 175° C. is in a temperature range lower than an inflection point (see FIG. 4) of fixing belts a to f, and 185° C. is in a temperature range higher than the inflection point (see FIG. 4) of the fixing belts a to f, and as a result, these temperatures are regarded as the surface temperature (fixing temperature) of the fixing belt.

The obtained results are shown in the following Table 5.

TABLE 5

| | | Storage elastic modulus of toner (Pa) | | Content of wax | Melting point of wax | Fixing belt | | Gloss | |
|---|---|---|---|---|---|---|---|---|---|
| | Toner type | 70° C. | 90° C. | (mass %) | (° C.) | Type | Storage elastic modulus of elastic layer material (Pa) | 175° C. | 185° C. |
| Example 1 | 1 | $3.0 \times 10^6$ | $3.0 \times 10^4$ | 10 | 75 | a | $1.4 \times 10^6$ | 18 | 40 |
| Example 2 | 2 | $3.5 \times 10^6$ | $3.7 \times 10^4$ | 6 | 75 | a | $1.4 \times 10^6$ | 18 | 35 |
| Example 3 | 1 | $3.0 \times 10^6$ | $3.0 \times 10^4$ | 10 | 75 | b | $2.3 \times 10^6$ | 20 | 50 |
| Example 4 | 3 | $2.8 \times 10^6$ | $3.2 \times 10^4$ | 10 | 75 | b | $2.3 \times 10^6$ | 24 | 49 |
| Example 5 | 4 | $3.2 \times 10^6$ | $3.0 \times 10^4$ | 10 | 75 | b | $2.3 \times 10^6$ | 19 | 50 |
| Example 6 | 5 | $3.0 \times 10^6$ | $2.7 \times 10^4$ | 10 | 65 | b | $2.3 \times 10^6$ | 21 | 51 |
| Example 7 | 6 | $3.0 \times 10^6$ | $3.3 \times 10^4$ | 10 | 85 | b | $2.3 \times 10^6$ | 21 | 44 |
| Example 8 | 1 | $3.0 \times 10^6$ | $3.0 \times 10^4$ | 10 | 75 | c | $2.3 \times 10^6$ | 23 | 47 |
| Example 9 | 1 | $3.0 \times 10^6$ | $3.0 \times 10^4$ | 10 | 75 | d | $2.3 \times 10^6$ | 22 | 50 |
| Example 10 | 1 | $3.0 \times 10^6$ | $3.0 \times 10^4$ | 10 | 75 | e | $2.3 \times 10^6$ | 24 | 52 |
| Example 11 | 1 | $3.0 \times 10^6$ | $3.0 \times 10^4$ | 10 | 75 | f | $2.3 \times 10^6$ | 19 | 35 |
| Comparative Example 1 | 1 | $3.0 \times 10^6$ | $3.0 \times 10^4$ | 10 | 75 | g | $4.5 \times 10^6$ | 45 | 50 |
| Comparative Example 2 | 1 | $3.0 \times 10^6$ | $3.0 \times 10^4$ | 10 | 75 | h | $0.85 \times 10^6$ | 20 | 24 |
| Comparative Example 3 | 7 | $6.0 \times 10^6$ | $4.4 \times 10^4$ | 6 | 75 | a | $1.4 \times 10^6$ | 17 | 33 |
| Comparative Example 4 | 8 | $1.8 \times 10^6$ | $2.7 \times 10^4$ | 16 | 85 | a | $1.4 \times 10^6$ | 28 | 46 |

It was considered that the high gloss is good if the gloss is 35 or more, and excellent if the gloss is 40 or more. From the results in the above Table 5, it was confirmed in Examples that the image with high gloss is obtained at the surface temperature (fixing temperature) of the fixing belt of 185° C. On the other hand, it was considered that the low gloss is good if the gloss is 25 or less, and excellent if the gloss is 20 or less. From the results in the above Table 5, it was confirmed in Examples that the image with low gloss is obtained at the surface temperature (fixing temperature) of the fixing belt of 175° C.

From the above, it could be confirmed in Examples that it is possible to stably obtain the image with low gloss and the image with high gloss only by slightly changing the fixing temperature by 10° C. by combining the fixing belt having the elastic layer containing the material having the storage elastic modulus in the above-described specific range with the toner having the storage elastic modulus in the specific range. As described above, it was found that the image with high gloss and the image with low gloss can be easily formed only by slightly changing the fixing temperature. Therefore, it is possible to avoid increasing the size and cost of the image forming apparatus and it is possible to form an image having various glosses according to the user's request only by changing the fixing temperature in multiple stages.

On the other hand, when the storage elastic modulus of the elastic layer material at 200° C. is less than $1.0\times10^6$ Pa, there is no inflection point as shown in FIG. 4 even when combined with a toner having a storage elastic modulus in a specific range. Therefore, it could be confirmed that the image with high gloss cannot be obtained and only the image with low gloss can be formed (see the graph of Comparative Example 2 and belt 3 of FIG. 4), only by changing the fixing temperature by 10° C.

In addition, when the storage elastic modulus of the elastic layer material at 200° C. exceeds $2.5\times10^6$ Pa, there is no inflection point as shown in FIG. 4 even when combined with a toner having a storage elastic modulus in a specific range. Therefore, it could be confirmed that the image with low gloss cannot be obtained and only the image with high gloss can be formed (see the graph of Comparative Example 1 and belt 1 of FIG. 4), only by changing the fixing temperature by 10° C.

In addition, when the storage elastic modulus of the toner at 90° C. exceeds $4.0\times10^4$ Pa, the image with low gloss is obtained but the image with sufficiently high gloss is not obtained, only by changing the fixing temperature by 10° C. even when the fixing belt having the elastic layer using the elastic layer material having the storage elastic modulus in the specific range is combined. Therefore, it could be confirmed that the image with high gloss and the image with low gloss cannot be freely formed (see Comparative Example 3).

In addition, when the storage elastic modulus of the toner at 70° C. is less than $2.0\times10^6$ Pa, the image with high gloss can be formed but the image with sufficiently low gloss cannot be formed, only by changing the fixing temperature by 10° C. even when the fixing belt having the elastic layer using the elastic layer material having the storage elastic modulus in the specific range is combined. Therefore, it could be confirmed that the image with high gloss and the image with low gloss cannot be freely formed (see Comparative Example 4).

Although embodiments of the present invention have been described and illustrated in detail, the disclosed embodiments are made for the purpose of illustration and example only and not limitation. The scope of the present invention should be interpreted by terms of the appended claims.

What is claimed is:

1. An image forming method, comprising:

developing an electrostatic latent image formed on a photoreceptor with a toner;

transferring a formed toner image onto a recording material; and fixing the toner image on a surface of the recording material, wherein a storage elastic modulus of the toner is $2.0\times10^6$ Pa or more at 70° C. and $4.0\times10^4$ Pa or less at 90° C., and in the fixing, a fixing belt having an elastic layer which contains a material having a storage elastic modulus of $1.0\times10^6$ Pa or more and $2.5\times10^6$ Pa or less at 200° C. is used.

2. The image forming method according to claim 1, wherein the toner contains wax, and a content of wax in the toner is 8 mass % or more and 15 mass % or less.

3. The image forming method according to claim 1, wherein the toner contains a binder resin, and the binder resin contains a crystalline polyester resin.

4. The image forming method according to claim 1, wherein the toner has a toner base particle, and the toner base particle has a core-shell structure.

5. The image forming method according to claim 1, wherein the toner contains wax, and a melting point of the wax is a range of 70° C. or higher and 80° C. or lower.

6. The image forming method according to claim 1, wherein the fixing belt is a belt having a base layer, the elastic layer, and a surface layer in this order, and a thickness of the elastic layer is 150 μm or more and 500 μm or less.

7. The image forming method according to claim 6, wherein a thickness of the surface layer is 5 μm or more and 50 μm or less.

8. An image forming apparatus including a toner and a fixing belt used in the image forming method according to claim 1, the image forming apparatus comprising:

a developing section which accommodates the toner and develops an electrostatic latent image formed on a photoreceptor with the toner;

a transfer section which transfers the formed toner image onto a recording material; and a fixing section which passes the recording material having the toner image formed on a surface thereof through a fixing nip and fixes the toner image on the surface of the recording material using the fixing belt, wherein the fixing section includes:

an endless fixing belt;

a heating roller which has a heating device for heating the fixing belt from an inside thereof and two or more rollers which pivotally support the fixing belt; and a pressure roller which is disposed so as to be relatively biased to one of the two or more rollers via the fixing belt, and a diameter of a roller biased to the pressure roller among the two or more rollers is 45 mm or more.

9. The image forming apparatus according to claim 8, wherein the fixing belt is pivotally supported by the two or more rollers so as to have a tension of 46 N or less.

* * * * *